US007150964B2

(12) United States Patent
Yanagisawa

(10) Patent No.: US 7,150,964 B2
(45) Date of Patent: Dec. 19, 2006

(54) PROCESS FOR TREATING PHOTOTHERMOGRAPHIC DRY IMAGING MATERIAL

(75) Inventor: Hiroyuki Yanagisawa, Hino (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 1 day.

(21) Appl. No.: 11/141,846

(22) Filed: Jun. 1, 2005

(65) Prior Publication Data

US 2005/0271986 A1 Dec. 8, 2005

(30) Foreign Application Priority Data

Jun. 7, 2004 (JP) ..... 2004-168637

(51) Int. Cl.
*G03C 1/498* (2006.01)

(52) U.S. Cl. ..... 430/617; 430/618; 430/619; 430/620

(58) Field of Classification Search ..... 430/617, 430/618, 619, 620
See application file for complete search history.

(56) References Cited

U.S. PATENT DOCUMENTS

2003/0207216 A1* 11/2003 Fukui et al. ..... 430/350
2004/0033449 A1* 2/2004 Inoue ..... 430/523

OTHER PUBLICATIONS

Abstract of JP 2006023717 A.*
Derwent abstract 2006-009685.*

* cited by examiner

*Primary Examiner*—Hoa Van Le
(74) *Attorney, Agent, or Firm*—Lucas & Mercanti, LLP

(57) ABSTRACT

Disclosed is an image forming process having the steps of exposing by an exposure device a photothermographic dry imaging material with a support having thereon an image forming layer containing photosensitive silver halide, a reducing agent for silver ions, a binder and a light-insensitive organic silver salt, and developing the photothermographic dry imaging material by a developing device, while the photothermographic dry imaging material is transported, wherein a surface having the image forming layer is brought into contact with sticky rollers during or before each of exposing and developing so as to make an amount of peel-off static electrification between the photothermographic dry imaging material and the sticky roller to be from −5 to +5 kV.

13 Claims, 1 Drawing Sheet

PROCESS FOR TREATING PHOTOTHERMOGRAPHIC DRY IMAGING MATERIAL

This application claims priority from Japanese Patent Application No. JP2004-168637 filed on Jun. 7, 2004, which is incorporated hereinto by reference.

TECHNICAL FIELD

The present invention relates to a process for treating photothermographic dry imaging materials (hereinafter occasionally referred to simply as photothermographic materials), employing a thermal development apparatus.

BACKGROUND

In recent years, in the medical and graphic arts fields, a decrease in the processing effluent of image forming materials has increasingly been demanded from the viewpoint of environmental protection as well as space saving.

As a result, techniques have been sought which relate to photothermographic materials which can be effectively exposed, employing laser imagers and laser image setters, and can form clear black-and-white images exhibiting high resolution.

Silver salt photothermographic dry imaging materials are composed of a support having thereon organic silver salts, photosensitive silver halide and reducing agents (for example, refer to Patent Documents 1 and 2, and Non-Patent Document 1.). Since no solution-based processing chemicals are employed for the aforesaid silver salt photothermographic dry imaging materials, they exhibit advantages in that it is possible to provide a simpler environmentally friendly system.

High image quality, based on enhanced sharpness, and excellent graininess and in-plane evenness, is desired to obtain sensitive delineation in medical images. Performance of high image quality has especially been demanded in order to photographically capture tumor mass shadows inside mammary glands, especially for early detection of breast cancer, employing mammography. Major improvement in this technique has long been desired, specifically since dust and foreign matter in the air or which adhere to the image film can early be misdiagnosed as calcification-like negative image (being a false image). To overcome this problem, a significant amount of dust and foreign matter is still a problem, even though commonly known removal means, such as sticky rollers are employed.

Though a technique of eliminating dust and foreign matter has improved by increasing contact pressure of the sticky rollers onto the photothermographic dry imaging materials is for example described in Patent Document 3, adhesion of dust and foreign matter recurs, since static electrification is generated when photothermographic dry imaging materials are peeled from the sticky rollers. As a result, it is easily to be understood that insufficient elimination of dust and foreign matter is obtained via this technique.

(Patent Document 1) U.S. Pat. No. 3,152,904 (Scope of Patent Claims)

(Patent Document 2) U.S. Pat. No. 3,487,075 (Scope of Patent Claims)

(Non-Patent Document 1) D. Morgan, B. Shely; Thermally Processed Silver Systems A; Imagining Processes and Materials: Neblette, $8^{th}$ edition, Sturge, V. Walworth, A. Shepp edition, page 2, 1969

(Patent Document 3) Japanese Patent O.P.I. Publication No. 2003-107625 (Scope of Patent Claims)

SUMMARY

The present invention was accomplished in view of the above unresolved items, and it is an object of the present invention to provide a process for treating photothermographic dry imaging materials, and a thermal development apparatus capable of producing high quality diagnostic images, especially high quality images desired for mammary diagnosis.

BRIEF DESCRIPTION OF THE DRAWINGS

Embodiments will now be described, by way of example only, with reference to the accompanying drawings which are meant to be exemplary, not limiting, and wherein like elements numbered alike in several Figures, in which.

DESCRIPTION OF THE PREFERRED EMBODIMENTS

Figure 1:
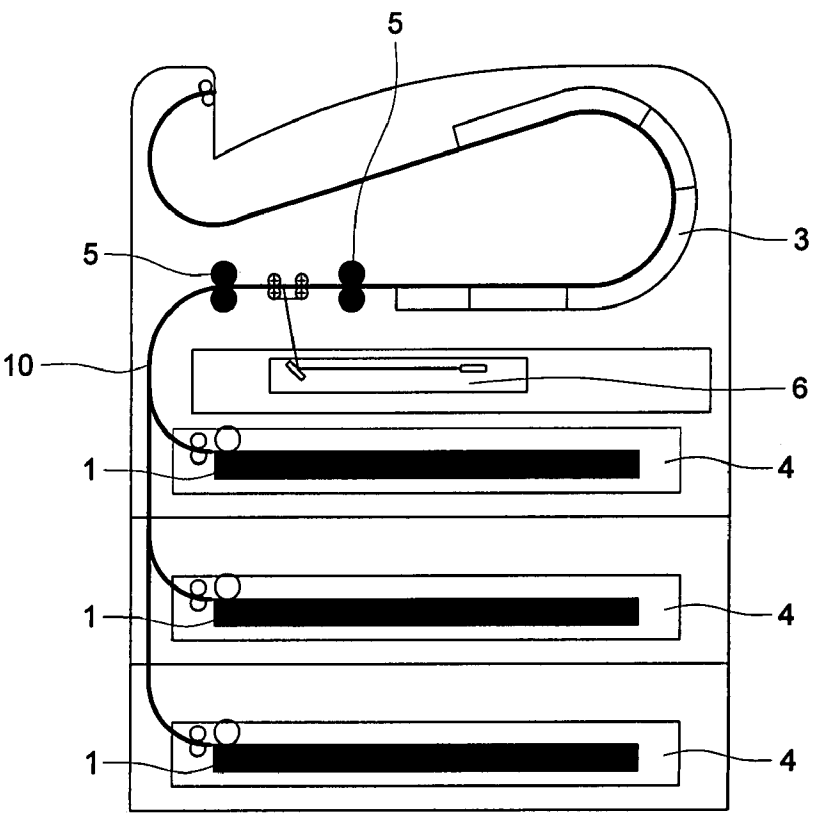
FIG. 1 shows schematic drawings of a laser imager which is a thermal development apparatus of the present invention.
Figure 1:
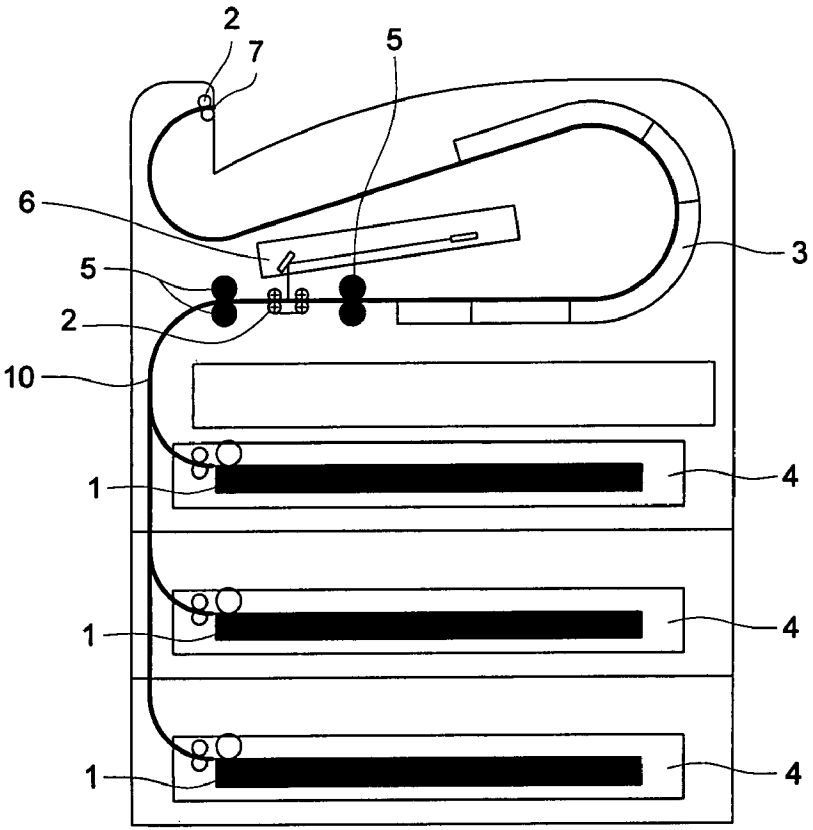

The aforesaid object can be accomplished via the following structures.

(Structure 1) An image forming process having the steps of: (a) exposing by an exposure device a photothermographic dry imaging material with a support having thereon an image forming layer containing photosensitive silver halide, a reducing agent for silver ions, a binder and a light-insensitive organic silver salt, and (b) developing the photothermographic dry imaging material by a developing device, while the photothermographic dry imaging material is transported, wherein a surface having the image forming layer is brought into contact with sticky rollers during or before each of exposing and developing so as to make an amount of peel-off static electrification between the photothermographic dry imaging material and the sticky roller to be from −5 to +5 kV.

(Structure 2) The image forming process of Structure 1, wherein exposure is conducted with an exposure device located below where the photothermographic dry imaging material is exposed.

(Structure 3) The image forming process of Structure 1 or 2, wherein an air cleanliness class defined by ISO 14644-1 at the portion of an exposure device is not more than 5.

(Structure 4) The image forming process of Structure 1 or 2, wherein the air cleanliness class defined by ISO 14644-1 at the portion of a developing device is not more than 5.

(Structure 5) The image forming process of any one of Structures 1–4, wherein sticky rollers possess a function to remove static electrification.

(Structure 6) The image forming process of any one of Structures 1–5, wherein static electrification is removed when the photothermographic dry imaging material is brought into contact with sticky rollers.

(Structure 7) The image forming process of any one of Structures 1–6, wherein static electrification is removed before the photothermographic dry imaging material is brought into contact with sticky rollers.

(Structure 8) An image forming process having the steps of: (a) exposing by an exposure device a photothermographic dry imaging material possessing a support having thereon an image forming layer containing photosensitive silver halide, a reducing agent for silver ions, a binder and a light-insensitive organic silver salt, and (b) developing the photothermographic dry imaging material by a developing device, while the photothermographic dry imaging material is transported, wherein the exposure device is located below the photothermographic dry imaging material when the photothermographic dry imaging material is exposed.

(Structure 9) The image forming process of Structure 8, wherein one or both surfaces having the image forming layer composed of the photothermographic dry imaging material, are brought into contact with sticky rollers at or before each of the exposure and developing devices.

(Structure 10) The image forming process of Structure 8 or 9, wherein the amount of peel-off static electrification between the photothermographic dry imaging material and the sticky roller is from −5 to +5 kV.

(Structure 11) The image forming process of any one of Structures 8–10, wherein the air cleanliness class defined by ISO 14644-1 at the portion of an exposure device is not more than 5.

(Structure 12) The image forming process of any one of Structures 8–11, wherein the air cleanliness class defined by ISO 14644-1 at the portion of a developing device is not more than 5.

(Structure 13) The image forming process of any one of Structures 8–12, wherein the sticky rollers possess a function to remove static electrification.

(Structure 14) The image forming process of any one of Structures 8–13, wherein static electrification is removed, before the photothermographic dry imaging material is brought into contact with the sticky rollers.

(Structure 15) The image forming process of any one of Structures 1–14, wherein a transporting speed at the developing device is from 30 to 60 mm/second.

(Structure 16) The image forming process of any one of Structures 1–15, wherein the photothermographic dry imaging material comprises a light-sensitive layer containing silver halide particles and aliphatic carboxylic acid silver, and the content ratio of silver behenate in the aliphatic carboxylic acid silver is from 80 to 100 percent by mol.

(Structure 17) The image forming process of any one of Structures 1–16, wherein the photothermographic dry imaging material comprises a light-sensitive layer containing silver halide particles and reducing agents for silver ions, and the reducing agents for silver ions are compounds represented by the following General Formula (RED).

General Formula (RED)

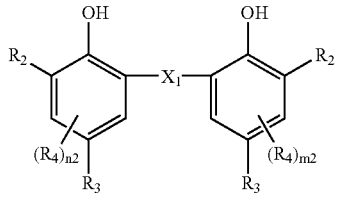

wherein $X_1$ represents a chalcogen atom or $CHR_1$; $R_1$ being a hydrogen atom, a halogen atom, an alkyl group, an, alkenyl group, an aryl group or a heterocyclic group; $R_2$ represents an alkyl group; $R_3$ represents a hydrogen atom or a substituent capable of substituting a hydrogen atom on a benzene ring; $R_4$ represents a substituent; and m2 and n2 each represents an integer of 0 to 2.

(Structure 18) The image forming process of any one of Structures 1–17, wherein the photothermographic dry imaging material comprises a light-sensitive layer containing photosensitive silver halide particles, and the photosensitive silver halide particles are chemically sensitized employing organic sensitizers containing chalcogen atoms.

(Structure 19) The image forming process of any one of Structures 1–18, wherein color image forming agents are contained which increase absorbance between 360 and 450 nm via oxidation.

(Structure 20) The image forming process of any one of Structures 1–19, wherein color image forming agents are contained which increase absorbance between 600 and 700 nm via oxidation.

While the preferred embodiments of the present invention have been described using specific terms, such description is for illustrative purposes only, and it is to be understood that changes and variations may be made without departing from the spirit or scope of the appended claims.

DETAILED DESCRIPTION OF THE INVENTION

The present invention will now be detailed. It is a feature in the present invention that one or both surfaces having an image forming layer (hereinafter occasionally referred to as a light-sensitive surface) composed of a photothermographic dry imaging material (occasionally referred to simply as a photothermographic material or a thermally developable light-sensitive material) are brought into contact with sticky rollers so as to make an amount of peel-off static electrification between the photothermographic dry imaging material and the sticky roller to be from −5 to +5 kV, preferably from −3 to +3 kV, or more preferably from −2 to +2 kV. In the case of the amount of peel-off static electrification being less than −5 kV or more than 5 kV, the desired effect of the present invention can not be attained, and a decline of image quality is observed. Desired effects of the present invention can also not be attained, when a light-insensitive surface is merely brought into contact with the sticky rollers.

No special technique is specifically required in the present invention to make the peel-off static electrification to be from −5 to +5 kV. However, it is preferred that the static electrification is simply removed with sticky rollers having a function of removing the static electrification, though a surface active agent is added into the photothermographic dry imaging material, or an electrically conductive support is employed.

The adhesive force of sticky rollers in the present invention is preferably in the range of 10–65 hPa, or more preferably 10–30 hPa, and excellent cleaning function is achieved in this range. In the case of the adhesive force of sticky rollers being at least 65 hPa, the adhesive force is too strong so that an image forming layer composed of a photothermographic dry imaging material or a backing layer is ripped off, and as a result the image quality frequently drops drastically. On the other hand, in the case of the adhesive force of the sticky rollers being at most 10 hPa, the adhesive force is too weak so that the desired effect of removing foreign matter can not be realized.

An adhesive force between a metal plate and rubber is expressed by the following formula, based on "samples in which two metal plates adhere to each other via rubber" in the physical test method of rubber vulcanization defined by JIS-K6301 for the adhesive force measurement.

Adhesive force=Maximum peel-off load/Area of adhesion

In the recording apparatus of the present invention, hardness (JIS A) is preferably in the range of 10–70°, whereby an excellent cleaning function is ensured. In the case of the hardness being at most 10°, the sticky rollers are too soft so that the sticky rollers tend to be easily damaged, and also resulting in problems of transportability of photothermographic dry imaging materials. On the other hand, in the case of the hardness being at least 70°, the sticky rollers are too hard so that the sticky rollers are not transformable, the contact area between the photothermographic dry imaging material and the sticky rollers decreases, or no contact area exists in the direction of the axis of the sticky roller, and the desired effect of removing foreign matter can not be obtained.

Commonly known materials for roller surfaces used for removing dust and foreign matter may be composed of urethane rubber, silicone rubber, or butyl rubber. Materials of the roller surface can be appropriately selected in response to the support, the subbing layer, and the type of foreign matter. It is also preferred that the diameter of the sticky roller is approximately 1.0–10.0 cm, and the roller width is determined to match the width of the light-sensitive materials.

It is preferred that an air cleanliness class defined by ISO 14644-1 at the portion of the exposure device or the developing device in the recording apparatus of the present invention is not more than 5. Though the pressure at the portion of the exposure device or the developing device is increased so as to result in the peripheral portion to be at a negative pressure, and dust and foreign matter are removed via filters by recirculating air within the apparatus, no specific technique is required as a special air cleaning means in the present invention.

It is a feature of the recording apparatus of the present invention that the static electrification is removed before or when the photothermographic dry imaging material is brought into contact with the sticky roller. Though for removing static electrification the photothermographic dry imaging material may be brought into contact with a bar or a brush prior to sticky rollers, it is preferred that the static electrification is simply removed via the rollers incorporating such a function.

It is a feature of another embodiment concerning the image forming process of the present invention that the photothermographic dry imaging material located above the exposure device is exposed from the lower side of the photothermographic dry imaging material. Even though dust and foreign matter once adhere to the light-sensitive surface of the photothermographic dry imaging material, they are easily removed due to gravity by incorporating the previous technique. Lowering specific resistance of the light-sensitive surface is further effective for easily removing dust and foreign matter because of gravity. For this purpose, it is preferred that surface active agents, to be described later, are employed, a subbing layer composed of tin oxide or titanium oxide, whose surface is covered with antimony, is provided, and a protective layer employing electrically conductive polymers, such as polythiophene or polyaniline, is also provided. The image quality is further improved, since dust and foreign matter which adhere to the photothermographic dry imaging material are more effectively removed via these means. In the case of using a conventional type of technique in which the exposure device is located above the photothermographic dry imaging material, and the photothermographic dry imaging material is exposed from the upper side of the photothermographic dry imaging material, dust and foreign matter which adhere to the light-sensitive surface can not be removed, and accumulated dust and foreign matter frequently cause image defects after development. In order to sufficiently obtain effect of this invention, the exposure device is desired to be located below where the photothermographic dry imaging material is exposed, and the angle between the scanning surface of the photothermographic dry imaging material and the scanning laser beam is commonly from 55 to 90 degrees, preferably from 5.5 to 88 degrees, more preferably from 60 to 86 degrees, still more preferably from 65 to 84 degrees, but most preferably from 70 to 82 degrees.

In the case of using sticky rollers for an extended period of time, foreign matter starts to adhere to the surfaces of the sticky rollers, and a decline of adhesive performance tends to occur. In this case, adhesive performance can be recovered, whereby the sticky rollers are removed at regular intervals, and any foreign matter adhering to the sticky rollers is removed by washing the roller surface with pure water. It is possible that sticky rollers may be reused. Cleaning rollers being brought into contact with the surfaces of sticky rollers may also be used. Adhesive performance of the sticky rollers can be continuously maintained, since dust and foreign matter on the surfaces of sticky rollers adhere to the more tacky surfaces of cleaning rollers in such case.

Though the transporting speed of photosensitive material at the exposure and developing devices is appropriately determined, higher speed is desired to improve not only quick processing but also higher throughput. However, the transporting speed is preferably from 10 to 15 mm/second, more preferably from 23 to 60 mm/second, and still more preferably from 30 to 60 mm/second.

<Silver Halide Grains>

Photosensitive silver halide grains (hereinafter simply referred to as silver halide grains) will be described which are employed in the silver salt photothermographic dry imaging material of the present invention (hereinafter simply referred to as the photosensitive material of the present invention).

The photosensitive silver halide grains, as described in the present invention, refer to silver halide crystalline grains which can originally absorb light as an inherent quality of silver halide crystals, can absorb visible light or infrared radiation through artificial physicochemical methods and are treatment-produced so that physicochemical changes occur in the interior of the silver halide crystal and/or on the crystal surface, when the crystals absorb any radiation from ultraviolet to infrared.

Silver halide grains employed in the present invention can be prepared in the form of silver halide grain emulsions, employing methods described in P. Glafkides, "Chimie et Physique Photographiques" (published by Paul Montel Co., 1967), G. F. Duffin, "Photographic Emulsion Chemistry" (published by The Focal Press, 1955), and V. L. Zelikman et al., "Making and Coating Photographic Emulsion", published by The Focal Press, 1964). Namely, any of an acidic method, a neutral method, or an ammonia method may be employed. Further, employed as methods to allow water-soluble silver salts to react with water-soluble halides may be any of a single-jet precipitation method, a double-jet precipitation method, or combinations-thereof. However, of these methods, the so-called controlled double-jet precipitation method is preferably employed in which silver halide grains are prepared while controlling formation conditions.

Halogen compositions are not particularly limited. Any of silver chloride, silver chlorobromide, silver chloroiodobromide, silver bromide, silver iodobromide, or silver iodide may be employed. Of these, silver bromide or silver iodobromide is particularly preferred.

The content ratio of iodine in silver iodobromide is. preferably in the range of 0.02 to 16 mol percent per Ag mol. Iodine may be incorporated so that it is distributed into the entire silver halide grain. Alternatively, a core/shell structure may be formed in which, for example, the concentration of iodine in the central portion of the grain is increased, while the concentration near the grain surface is simply decreased or substantially decreased to zero.

Grain formation is commonly divided into two stages, that is, the formation of silver halide seed grains (being nuclei) and the growth of the grains. Either method may be employed in which two stages are continually carried out, or in which the formation of nuclei (seed grains) and the growth of grains are carried out separately. A controlled double-jet precipitation method, in which grains are formed while controlling the pAg and pH which are grain forming conditions, is preferred, since thereby it is possible to control grain shape as well as grain size. For example, when the method, in which nucleus formation and grain growth are separately carried out, is employed, initially, nuclei (being seed grains) are formed by uniformly and quickly mixing water-soluble silver salts with water-soluble halides in an aqueous gelatin solution. Subsequently, under the controlled pAg and pH, silver halide grains are prepared through a grain growing process which grows the grains while supplying water-soluble silver salts as well as water-soluble halides.

In order to minimize milkiness (or white turbidity) as well as coloration (yellowing) after image formation and to obtain excellent image quality, the average grain diameter of the silver halide grains, employed in the present invention, is preferably rather small. The average grain diameter, when grains having a grain diameter of less than 0.02 μm is beyond practical measurement, is preferably 0.030 to 0.055 μm.

Incidentally, grain diameter, as described herein, refers to the edge length of silver halide grains which are so-called regular crystals such as a cube or an octahedron. Further, when silver halide gains are planar, the grain diameter refers to the diameter of the circle which has the same area as the projection area of the main surface.

In the present invention, silver halide grains are preferably in a state of monodispersion. Monodispersion, as described herein, means that the variation coefficient, obtained by the formula described below, is not more than 30 percent. The aforesaid variation coefficient is preferably not more than 20 percent, and is more preferably not more than 15 percent.

Variation coefficient (in percent) of grain diameter=standard deviation of grain diameter/average of grain diameter×100

Cited as shapes of silver halide grains may be cubic, octahedral and tetradecahedral grains, planar grains, spherical grains, rod-shaped grains, and roughly elliptical-shaped grains. Of these, cubic, octahedral, tetradecahedral, and planar silver halide grains are particularly preferred.

When the aforesaid planar silver halide grains are employed, their average aspect ratio is preferably 1.5 to 100, and is more preferably 2 to 50. These are described in U.S. Pat. Nos. 5,264,337, 5,314,798, and 5,320,958, and incidentally it is possible to easily prepare the aforesaid target planar grains. Further, it is possible to preferably employ silver halide grains having rounded corners.

The crystal habit of the external surface of silver halide grains is not particularly limited. However, when spectral sensitizing dyes, which exhibit crystal habit (surface) selectiveness are employed, it is preferable that silver halide grains are employed which have the crystal habit matching their selectiveness in a relatively high ratio. For example, when sensitizing dyes, which are selectively adsorbed onto a crystal plane having a Miller index of (100), it is preferable that the ratio of the (100) surface on the external surface of silver halide grains is high. The ratio is preferably at least 50 percent, is more preferably at least 70 percent, and is most preferably at least 80 percent. When sensitizing dyes, which are selectively adsorbed onto a crystal plane having a Miller index of (111), it is also preferable that the ratio of the (111) surface on the external surface of silver halide grains is high. Incidentally, it is possible to obtain a ratio of the surface having a Miller index of (100), based on T. Tani, J. Imaging Sci., 29, 165 (1985), utilizing adsorption dependence of sensitizing dye in a (111) plane as well as a (100) surface.

The silver halide grains, employed in the present invention, are preferably prepared employing low molecular weight gelatin, having an average molecular weight of not more than 50,000 during the formation of the grains, which are preferably employed during formation of nuclei. The low molecular weight gelatin refers to gelatin having an average molecular weight of not more than 50,000. The molecular weight is preferably from 2,000 to 40,000, and is more preferably from 5,000 to 25,000. It is possible to measure the molecular weight of gelatin employing gel filtration chromatography.

The concentration of dispersion media during the formation of nuclei is preferably not more than 5 percent by weight. It is more effective to carry out the formation at a low concentration of 0.05 to 3.00 percent by weight.

During formation of the silver halide grains employed in the present invention, it is possible to use polyethylene oxides represented by the general formula described below.

$$YO(CH_2CH_2O)_m(CH(CH_3)CH_2O)_p(CH_2CH_2O)_nY \quad \text{General Formula}$$

wherein Y represents a hydrogen atom, —$SO_3M^1$, or —CO-B-$COOM^1$; $M^1$ represents a hydrogen atom, an alkali metal atom, an ammonium group, or an ammonium group substituted with an alkyl group having not more than 5 carbon atoms; B represents a chained or cyclic group which forms an organic dibasic acid; m and n each represents 0 through 50; and p represents 1 through 100.

When silver halide photosensitive photographic materials are produced, polyethylene oxides, represented by the above general formula, have been preferably employed as anti-foaming agents to counter marked foaming which occurs while stirring and transporting emulsion raw materials in a process in which an aqueous gelatin solution is prepared, in the process in which water-soluble halides as well as water-soluble silver salts are added to the gelatin solution, and in a process in which the resultant emulsion is applied onto a support. Techniques to employ polyethylene oxides as an anti-foaming agent are disclosed in, for example, Japanese Patent O.P.I. Publication No. 44-9497. The polyethylene oxides represented by the above general formula function as an anti-foaming agent during nuclei formation.

The content ratio of polyethylene oxides, represented by the above general formula, is preferably not more than 1 percent by weight with respect to silver, and is more preferably from 0.01 to 0.10 percent by weight.

It is desired that polyethylene oxides, represented by the above general formula, are present during nuclei formation. It is preferable that they are previously added to the dispersion media prior to nuclei formation. However, they may also be added during nuclei formation, or they may be employed by adding them to an aqueous silver salt solution or an aqueous halide solution which is employed during nuclei formation. However, they are preferably employed by adding them to an aqueous halide solution, or to both aqueous solutions in an amount of 0.01 to 2.00 percent by weight. Further, it is preferable that they are present during at least 50 percent of the time of the nuclei formation process, and it is more preferable that they are present during at least 70 percent of the time of the same. The polyethylene oxides, represented by the above general formula, may be added in the form of powder or they may be dissolved in a solvent such as methanol and then added.

Incidentally, temperature during nuclei formation is commonly from 5 to 60° C., and is preferably from 15 to 50° C. It is preferable that the temperature is controlled within the range, even when a constant temperature, a temperature increasing pattern (for example, a case in which temperature at the initiation of nuclei formation is 25° C., subsequently, temperature is gradually increased during nuclei formation and the temperature at the completion of nuclei formation is 40° C.), or a reverse sequence may be employed.

The concentration of an aqueous silver salt solution and an aqueous halide solution, employed for nuclei formation, is preferably not more than 3.5 M/L, and is more preferably in the lower range of 0.01 to 2.50 M/L. The silver ion addition rate during nuclei formation per liter of reaction liquid is preferably from $1.5\times1^{-3}$ to $3.0\times10^{-1}$ mol/minute, and is more preferably from $3.0\times10^{-3}$ to $8.0\times10^{-2}$ mol/minute.

The pH during nuclei formation can be set in the range of 1.7 to 10.0. However, since the pH on the alkali side broadens the particle size distribution of the formed nuclei, the preferred pH is from 2 to 6. Further, the pBr during nuclei formation is usually from about 0.05 to about 3.00, is preferably from 1.0 to 2.5, and is more preferably from 1.5 to 2.0.

<Silver Halide Grains of Internal Latent Formation After Thermal Development>

The photosensitive silver halide grains according to the present invention are characterized in that they have a property to change from a surface latent image formation type to an internal latent image formation type after subjected to thermal development. This change is caused by decreasing the speed of the surface latent image formation by the effect of thermal development.

When the silver halide grains are exposed to light prior to thermal development, latent images capable of functioning as a catalyst of development reaction are formed on the surface of the aforesaid silver halide grains. "Thermal development" is a reduction reaction by a reducing agent for silver ions. On the other hand, when exposed to light after the thermal development process, latent images are more formed in the interior of the silver halide grains than the surface thereof. As a result, the silver halide grains result in retardation of latent image formation on the surface. It was not known in the field of a photothermographic material to employ the above-mentioned silver halide grains which largely change their latent image formation function before and after thermal development.

Generally, when photosensitive silver halide grains are exposed to light, silver halide grains themselves or spectral sensitizing dyes, which are adsorbed on the surface of photosensitive silver halide grains, are subjected to photoexcitation to generate free electrons. Generated electrons are competitively trapped by electron traps (sensitivity centers) on the surface or interior of silver halide grains. Accordingly, when chemical sensitization centers (chemical sensitization specks) and dopants, which are useful as an electron trap, are much more located on the surface of the silver halide grains than the interior thereof and the number is appropriate, latent images are dominantly formed on the surface, whereby the resulting silver halide grains become developable. Contrary to this, when chemical sensitization centers (chemical sensitization specks) and dopants, which are useful as an electron trap, are much more located in the interior of the silver halide grains than the surface thereof and the number is appropriate, latent images are dominantly formed in the interior, whereby it becomes difficult to develop the resulting silver halide grains. In other words, in the former, the surface speed is higher than interior speed, while in the latter, the surface speed is lower than the interior speed. The former type of latent image is called "a surface latent image", and the latter is called "an internal latent image". Examples of the references are:

(1) T. H. James ed., "The Theory of the Photographic Process" $4^{th}$ edition, Macmillan Publishing Co., Ltd. 1977; and (2) Japan Photographic Society, "Shashin Kogaku no Kiso" (Basics of Photographic Engineering), Corona Publishing Co. Ltd., 1998.

The photosensitive silver halide grains of the present invention are preferably provided with dopants which act as electron trapping in the interior of silver halide grains at least in a stage of exposure to light after thermal development. This is desired so as to achieve high photographic speed grains as well as high image keeping properties.

It is especially preferred that the dopants act as a hole trap during an exposure step prior to thermal development, and the dopants change after a thermal development step resulting in functioning as an electron trap.

Electron trapping dopants, as described herein, refer to silver, elements except for halogen or compounds constituting silver halide, and the aforesaid dopants themselves which exhibit properties capable of trapping free electron, or the aforesaid dopants are incorporated in the interior of silver halide grains to generate electron trapping portions such as lattice defects. For example, listed are metal ions other than silver ions or salts or complexes thereof, chalcogen (such as elements of oxygen family) sulfur, selenium, or tellurium, inorganic or organic compounds comprising nitrogen atoms, and rare earth element ions or complexes thereof.

Listed as metal ions, or salts or complexes thereof may be lead ions, bismuth ions, and gold ions, or lead bromide, lead carbonate, lead sulfate, bismuth nitrate, bismuth chloride, bismuth trichloride, bismuth carbonate, sodium bismuthate, chloroauric acid, lead acetate, lead stearate, and bismuth acetate.

Employed as compounds comprising chalcogen such as sulfur, selenium, and tellurium may be various chalcogen releasing compounds which are generally known as chalcogen sensitizers in the photographic industry. Further, preferred as organic compounds comprising chalcogen or nitrogen are heterocyclic compounds which include, for example, imidazole, pyrazole, pyridine, pyrimidine, pyrazine, pyridazine, triazole, triazine, idole, indazole, purine, thiazole, oxadiazole, quinoline, phthalazine, naphthylizine, quinoxaline, quinazoline, cinnoline, pteridine, acrydine, phenanthroline, phenazine, tetrazole, thiazole, oxazole, benzimidazole, benzoxazole, benzthiazole, indolenine, and tetraazaindene. Of these, preferred are imidazole, pyrazine, pyrimidine, pyrazine, pyridazine, triazole, triazine, thiadiazole, oxadiazole, quinoline, phthalazine, naphthylizine, quinoxaline, quinazoline, cinnoline, tetrazole, thiazole, oxazole, benzimidazole, benzoxazole, benzthiazole, and tetraazaindene.

Incidentally, the aforesaid heterocyclic compounds may have substituent(s). Preferable substituents include an alkyl group, an alkenyl group, an aryl group, an alkoxy group, an aryloxy group, an acyloxy group, an acyl group, an alkoxycarbonyl group, an aryloxycarbonyl group, an acyloxy group, an acylamino group, an alkoxycarbonylamino group, an aryloxycarbonylamino group, a sulfonylamino group, a sulfamoyl group, a carbamoyl group, a sulfonyl group, a ureido group, a phosphoric acid amide group, a halogen atom, a cyano group, a sulfo group, a carboxyl group, a nitro group, a heterocyclic group. Of these, more preferred are an alkyl group, an aryl group, an alkoxy group, an aryloxy group, an acyl group, an acylamino group, an alkoxycarbonylamino group, an aryloxycarbonylamino group, a sulfonylamino group, a sulfamoyl group, a carbamoyl group, a ureido group, a phosphoric acid amido group, a halogen atom, a cyano group, a nitro group, and a heterocyclic group. More preferred are an alkyl group, an aryl group, an alkoxy group, an aryloxy group, an acyl group, an acylamino group, a sulfonylamino group, a sulfamoyl group, a carbamoyl group, a halogen atom, a cyano group, a nitro group, and a heterocyclic group.

Incidentally, ions of transition metals which belong to Groups 6 through 11 in the Periodic Table may be chemically modified to form a complex employing ligands of the oxidation state of the ions and incorporated in silver halide grains employed in the present invention so as to function as an electron trapping dopant, as described above, or as a hole trapping dopant. Preferred as aforesaid transition metals are W, Fe, Co, Ni, Cu, Ru, Rh, Pd, Re, Os, Ir, and Pt.

In the present invention, aforesaid various types of dopants may be employed individually or in combination of at least two of the same or different types. It is preferred that at least one of the dopants act as an electron trapping dopant during an exposure time after being thermal developed. They may be incorporated in the interior of the silver halide grains in any forms of chemical states.

It is not recommended to use a complex or a salt of Ir or Cu as a single dopant without combining with other dopant.

The content ratio of dopants is preferably in the range of $1\times10^{-9}$ to $1\times10$ mol per mol of silver, and is more preferably $1\times10^{-6}$ to $1\times10^{-2}$ mol.

However, the optimal amount varies depending the types of dopants, the diameter and shape of silver halide grains, and ambient conditions. Accordingly, it is preferable that addition conditions are optimized taking into account these conditions.

In the present invention, preferred as transition metal complexes or complex ions are those represented by the general formula described below.

$$[ML_6]^m \qquad \text{General Formula}$$

wherein M represents a transition metal selected from the elements of Groups 6 through 11 in the Periodic Table; L represents a ligand; and m represents 0, -, 2-, 3-, or 4-. Listed as specific examples of ligands represented by L arena halogen ion (a fluoride ion, a chloride ion, a bromide ion, or an iodide ion), a cyanide, a cyanate, a thiocyanate, a selenocyanate, a tellurocyanate, an azide, and an aqua ligand, and nitrosyl and thionitrosyl. Of these, aqua, nitrosyl, and thionitrosyl are preferred. When the aqua ligand is present, one or two ligands are preferably occupied by the aqua ligand. L may be the same or different.

It is preferable that compounds, which provide ions of these metals or complex ions, are added during formation of silver halide grains so as to be incorporated in the silver halide grains. The compounds may be added at any stage of, prior to or after, silver halide grain preparation, namely nuclei formation, grain growth, physical ripening or chemical ripening. However, they are preferably added at the stage of nuclei formation, grain growth, physical ripening, are more preferably added at the stage of nuclei formation and growth, and are most preferably added at the stage of nuclei formation. They may be added over several times upon dividing them into several portions. Further, they may be uniformly incorporated in the interior of silver halide grains. Still further, as described in Japanese Patent O.P.I. Publication Nos. 63-29603, 2-306236, 3-167545, 4-76534, 6-110146, and 5-273683, they may be incorporated so as to result in a desired distribution in the interior of the grains.

These metal compounds may be dissolved in water or suitable organic solvents (for example, alcohols, ethers, glycols, ketones, esters, and amides) and then added. Further, addition methods include, for example, a method in which either an aqueous solution of metal compound powder or an aqueous solution prepared by dissolving metal compounds together with NaCl and KCl is added to a water-soluble halide solution, a method in which silver halide grains are formed by a silver salt solution, and a halide solution together with a the compound solution as a third aqueous solution employing a triple-jet precipitation method, a method in which, during grain formation, an aqueous metal compound solution in a necessary amount is charged into a reaction vessel, or a method in which, during preparation of silver halide, other silver halide grains which have been doped with metal ions or complex ions are added and dissolved. Specifically, a method is preferred in which either an aqueous solution of metal compound powder or an aqueous solution prepared by dissolving metal compounds together with NaCl and KCl is added to a water-soluble halide solution. When added onto the grain surface, an aqueous metal compound solution in a necessary amount may be added to a reaction vessel immediately after grain formation, during or after physical ripening, or during chemical ripening.

Incidentally, it is possible to introduce non-metallic dopants into the interior of silver halide employing the same method as the metallic dopants.

In the imaging materials in accordance with the present invention, it is possible to evaluate whether the aforesaid dopants exhibit electron trapping properties or not, while employing a method which has commonly employed in the photographic industry. Namely a silver halide emulsion composed of silver halide grains, which have been doped with the aforesaid dopant or decomposition product thereof so as to be introduced into the interior of grains, is subjected to photoconduction measurement, employing a microwave photoconduction measurement method. Subsequently, it is possible to evaluate the aforesaid electron trapping properties by comparing the resulting decrease in photoconduction to that of the silver halide emulsion comprising no dopant as a standard. It is also possible to evaluate the same by performing experiments in which the internal speed of the aforesaid silver halide grains is compared to the surface speed.

Further, a method follows which is applied to a finished photothermographic dry imaging material to evaluate the electron trapping dopant effect in accordance with the present invention. For example, prior to exposure, the aforesaid imaging material is heated under the same conditions as the commonly employed thermal development conditions. Subsequently, the resulting material is exposed to white light or infrared radiation through an optical wedge for a definite time (for example, 30 seconds), and thermally developed under the same thermal development conations as above, whereby a characteristic curve (or a densitometry curve) is obtained. Then, it is possible to evaluate the aforesaid electron trapping dopant effect by comparing the speed obtained based on the characteristic curve to that of the imaging material which is composed of the silver halide emulsion which does not comprise the aforesaid electron trapping dopant. Namely, it is preferred to confirm that the speed of the former sample composed of the silver halide grain emulsion comprising the dopant in accordance with the present invention is lower than the latter sample which does not comprise the aforesaid dopant.

Speed of the aforesaid material is obtained based on the characteristic curve which is obtained by exposing the aforesaid material to white light or infrared radiation through an optical wedge for a definite time (for example 30 seconds) followed by developing the resulting material under common thermal development conditions. Further, speed of the aforesaid material is obtained based on the characteristic curve which is obtained by heating the aforesaid material under common thermal development conditions prior to exposure and giving the same definite exposure as above to the resulting material for the same definite time as above followed by thermally developing the resulting material under common thermal development conditions. The ratio of the latter speed to the former speed is preferably at most 1/10, and is more preferably at most 1/20. When the silver halide emulsion is chemically sensitized, the preferred photographic speed ratio is as low as not more than 1/50.

The silver halide grains of the present invention may be incorporated in a photosensitive layer employing an optional method. In such a case, it is preferable that the aforesaid silver halide grains are arranged so as to be adjacent to reducible silver sources (being aliphatic carboxylic silver salts) in order to get an imaging material having a high covering power.

The silver halide of the present invention is previously prepared and the resulting silver halide is added to a solution which is employed to prepare aliphatic carboxylic acid silver salt particles. By so doing, since a silver halide preparation process and an aliphatic carboxylic acid silver salt particle preparation process are performed independently, production is preferably controlled. Further, as described in British Patent No. 1,447,454, when aliphatic carboxylic acid silver salt particles are formed, it is possible to almost simultaneously form aliphatic carboxylic acid silver salt particles by charging silver ions to a mixture consisting of halide components such as halide ions and aliphatic carboxylic acid silver salt particle forming components. Still further, it is possible to prepare silver halide grains utilizing conversion of aliphatic carboxylic acid silver salts by allowing halogen-containing components to act on aliphatic carboxylic acid silver salts. Namely, it is possible to convert some of aliphatic carboxylic acid silver salts to photosensitive silver halide by allowing silver halide forming components to act on the previously prepared aliphatic carboxylic acid silver salt solution or dispersion, or sheet materials comprising aliphatic carboxylic acid silver salts.

Silver halide grain forming components include inorganic halogen compounds, onium halides, halogenated hydrocarbons, N-halogen compounds, and other halogen containing compounds.

Specific examples are disclosed in; U.S. Pat. Nos. 4,009,039, 3,4757,075, 4,003,749; G.B. Pat. No. 1,498,956; and Japanese Patent O.P.I. Publication Nos. 53-27027, 53-25420.

Further, silver halide grains may be employed in combination which are produced by converting some part of separately prepared aliphatic carboxylic acid silver salts.

The aforesaid silver halide grains, which include separately prepared silver halide grains and silver halide grains prepared by partial conversion of aliphatic carboxylic acid silver salts, are employed commonly in an amount of 0.001 to 0.7 mol per mol of aliphatic carboxylic acid silver salts and preferably in an amount of 0.03 to 0.5 mol.

The separately prepared photosensitive silver halide particles are subjected to desalting employing desalting methods known in the photographic art, such as a noodle method, a flocculation method, an ultrafiltration method, and an electrophoresis method, while they may be employed without desalting.

<Light-insensitive Aliphatic Carboxylic Acid Silver Salt>

The light-insensitive aliphatic carboxylic acid silver salts according to the present invention are reducible silver sources which are preferably silver salts of long chain aliphatic carboxylic acids, having from 10 to 30 carbon atoms and preferably from 15 to 25 carbon atoms. Listed as examples of appropriate silver salts are those described below.

For example, listed are silver salts of gallic acid, oxalic acid, behenic acid, stearic acid, arachidic acid, palmitic acid, and lauric acid. Of these, listed as preferable silver salts are silver behenate, silver arachidate, and silver stearate.

Further, in the present invention, it is preferable that at least two types of aliphatic carboxylic acid silver salts are mixed since the resulting developing ability is enhanced and high contrast silver images are formed. Preparation is preferably carried out, for example, by mixing a mixture consisting of at least two types of aliphatic carboxylic acid with a silver ion solution.

On the other hand, from the viewpoint of enhancing retaining properties of images, the melting point of aliphatic carboxylic acids, which are employed as a raw material of aliphatic carboxylic acid silver, is commonly at least 50° C., and is preferably at least 60° C. The content ratio of aliphatic carboxylic acid silver salts is commonly at least 50 percent by mol, is preferably at least 70 percent by mol, and still more preferably from 80 to 100 percent by mol. From this viewpoint, specifically, it is preferable that the content ratio of silver behenate in the aliphatic carboxylic acid silver is higher.

Aliphatic carboxylic acid silver salts are prepared by mixing water-soluble silver compounds with compounds which form complexes with silver. When mixed, a normal precipitation method, a reverse precipitating method, a double-jet precipitation method, or a controlled double-jet precipitation method, described in Japanese Patent O.P.I. Publication No. 9-127643, are preferably employed. For example, after preparing a metal salt soap (for example, sodium behenate and sodium arachidate) by adding alkali metal salts (for example, sodium hydroxide and potassium hydroxide) to organic acids, crystals of aliphatic carboxylic acid silver salts are prepared by mixing the soap with silver nitrate. In such a case, silver halide grains may be mixed together with them.

The kinds of alkaline metal salts employed in the present invention include sodium hydroxide, potassium hydroxide, and lithium hydroxide, and it is preferable to simultaneously use sodium hydroxide and potassium hydroxide. When simultaneously employed, the mol ratio of sodium hydroxide to potassium hydroxide is preferably in the range of 10:90–75:25. When the alkali metal salt of aliphatic carboxylic acid is formed via a reaction with an aliphatic carboxylic acid, it is possible to control the viscosity of the resulting liquid reaction composition within the desired range.

Further, in the case in which aliphatic carboxylic acid silver is prepared in the presence of silver halide grains at an average grain diameter of at most 0.050 μm, it is preferable that the ratio of potassium among alkaline metals in alkaline metal salts is higher than the others, since dissolution of silver halide grains as well as Ostwald ripening is retarded. Further, as the ratio of potassium salts increases, it is possible to decrease the size of fatty acid silver salt particles. The ratio of potassium salts is preferably 50–100 percent with respect to the total alkaline metal salts, while the concentration of alkaline metal salts is preferably 0.1–0.3 mol/1,000 ml.

<Silver Salt Particles at a High Silver Ratio>

An emulsion containing aliphatic carboxylic acid silver salt particles according to the present invention is a mixture consisting of free aliphatic carboxylic acids which do not form silver salts, and aliphatic carboxylic acid silver salts. In view of storage stability of images, it is preferable that the ratio of the former is lower than the latter. Namely, the aforesaid emulsion according to the present intention preferably-contains aliphatic carboxylic acids in an amount of 3–10 mol percent with respect to the aforesaid aliphatic carboxylic acid silver salt particles, and most preferably 4–8 mol percent.

Incidentally, in practice, each of the amount of total aliphatic carboxylic acids and the amount of free aliphatic carboxylic acids is determined employing the methods described below. Whereby, the amount of aliphatic carboxylic acid silver salts and free aliphatic carboxylic acids, and each ratio, or the ratio of free carboxylic acids to total aliphatic carboxylic acids, are calculated.

(Quantitative Analysis of the Amount of Total Aliphatic Carboxylic Acids (the Total Amount of These Being Due to Both of the Aforesaid Aliphatic Carboxylic Acid Silver Salts and Free Acids))

(1) A sample in an amount (the weight when peeled from a photosensitive material) of approximately 10 mg is accurately weighed and placed in a 200 ml ovid flask.
(2) Subsequently, 15 ml of methanol and 3 ml of 4 mol/L hydrochloric acid are added and the resulting mixture is subjected to ultrasonic dispersion for one minute.
(3) Boiling stones made of Teflon (registered trade name) are placed and refluxing is performed for 60 minutes.
(4) After cooling, 5 ml of methanol is added from the upper part of the cooling pipe and those adhered to the cooling pipe are washed into the ovoid flask (this is repeated twice).
(5) The resulting liquid reaction composition is subjected to extraction employing ethyl acetate (separation extraction is performed twice by adding 100 ml of ethyl acetate and 70 ml of water).
(6) Vacuum drying is then performed at normal temperature for 30 minutes.
(7) Placed in a 10 ml measuring flask is 1 ml of a benzanthorone solution as an internal standard (approximately 100 mg of benzanthrone is dissolved in toluene and the total volume is made to 100 ml by the addition of toluene).
(8) The sample is dissolved in toluene and placed in the measuring flask described in (7) and the total volume is adjusted by the addition of toluene.
(9) Gas chromatography (GC) measurements are performed under the measurement conditions below.
Apparatus: HP-5890+HP-Chemistation
Column: HP-1 30 m×0.32 mm×0.25 μm (manufactured by Hewlett-Packard)
Injection inlet: 250° C.
Detector: 280° C.
Oven: maintained at 250° C.
Carrier gas: He
Head pressure: 80 kPa (Quantitative Analysis of Free Aliphatic Carboxylic Acids)

(1) A sample in an amount of approximately 20 mg is accurately weighed and placed in a 200 ml ovoid flask. Subsequently, 100 ml of methanol was added and the resulting mixture is subjected to ultrasonic dispersion (free organic carboxylic acids are extracted).
(2) The resulting dispersion is filtered. The filtrate is placed in a 200 ml ovoid flask and then dried up (free organic carboxylic acids are separated).
(3) Subsequently, 15 ml of methanol and 3 ml of 4 mol/L hydrochloric acid are added and the resulting mixture is subjected to ultrasonic dispersion for one minute.
(4) Boiling stones made of Teflon (registered trade mark) were added, and refluxing is performed for 60 minutes.
(5) Added to the resulting liquid reaction composition are 60 ml of water and 60 ml of ethyl acetate, and a methyl-esterificated product of organic carboxylic acids is then extracted to an ethyl acetate phase. Ethyl acetate extraction is performed twice.
(6) The ethyl acetate phase is dried, followed by vacuum drying for 30 minutes.
(7) Placed in a 10 ml measuring flask is 1 ml of a benzanthorone solution (being an internal standard and prepared in such a manner that approximately 100 mg of benzanthrone is dissolved in toluene and the total volume is made to 100 ml by the addition of toluene).
(8) The product obtained in (6) is dissolved in toluene and placed in the measuring flask described in (7) and the total volume is adjusted by the addition of more toluene.
(9) GC measurement carried out using the conditions described below.
Apparatus: HP-5890+HP-Chemistation
Column: HP-1 30 m×0.32 mm×0.25 μm (manufactured by Hewlett-Packard)
Injection inlet: 250° C.
Detector: 280° C.
Oven: maintained at 250° C.
Carrier gas: He
Head pressure: 80 kPa <Morphology of Aliphatic Carboxylic Acid Silver Salts>

Aliphatic carboxylic acid silver salts according to the present invention may be crystalline grains which have the core/shell structure disclosed in European Patent No. 1168069A1 and Japanese Patent O.P.I. Publication No. 2002-023303. Incidentally, when the core/shell structure is formed, organic silver salts, except for aliphatic carboxylic acid silver, such as silver salts of phthalic acid and benzimidazole may be employed wholly or partly in the core portion or the shell portion as a constitution component of the aforesaid crystalline grains.

In the aliphatic carboxylic acid silver salts according to the present invention, it is preferable that the average circle equivalent diameter is from 0.05 to 0.80 μm, and the average thickness is from 0.005 to 0.070 μm. It is more preferable that the average circle equivalent diameter is from 0.2 to 0.5 μm, and the average thickness is from 0.01 to 0.05 μm.

When the average circle equivalent diameter is not more than 0.05 μm, excellent transparency is obtained, while image retention properties are degraded. On the other hand, when the average grain diameter is not more than 0.8 μm, transparency is markedly degraded. When the average thickness is not more than 0.005 μm, during development, silver ions are abruptly supplied due to the large surface area and are present in a large amount in the layer, since specifically in the low density section, the silver ions are not used to form silver images. As a result, the image retention properties are markedly degraded. On the other hand, when the average thickness is not less than 0.07 μm, the surface area decreases, whereby image stability is enhanced. However, during development, the silver supply rate decreases and in the high density section, silver formed by development results in non-uniform shape, whereby the maximum density tends to decrease.

The average circle equivalent diameter can be determined as follows. Aliphatic carboxylic acid silver salts, which have been subjected to dispersion, are diluted, are dispersed onto a grid covered with a carbon supporting layer, and imaged at a direct magnification of 5,000, employing a transmission type electron microscope (Type 2000FX, manufactured by JEOL, Ltd.). The resultant negative image is converted to a digital image employing a scanner. Subsequently, by employing appropriate software, the grain diameter (being a circle equivalent diameter) of at least 300 grains is determined and an average grain diameter is calculated.

It is possible to determine the average thickness, employing a method utilizing a transmission electron microscope (hereinafter referred to as a TEM) as described below.

First, a photosensitive layer, which has been applied onto a support, is adhered onto a suitable holder, employing an adhesive, and subsequently, cut in the perpendicular direction with respect to the support plane, employing a diamond knife, whereby ultra-thin slices having a thickness of 0.1 to 0.2 μm are prepared. The ultra-thin slice is supported by a copper mesh and transferred onto a hydrophilic carbon layer, employing a glow discharge. Subsequently, while cooling the resultant slice at not more than −130° C. employing liquid nitrogen, a bright field image is observed at a magnification of 5,000 to 40,000, employing TEM, and images are quickly recorded employing either film, imaging plates, or a CCD camera. During the operation, it is preferable that the portion of the slice in the visual field is suitably selected so that neither tears nor distortions are imaged.

The carbon layer, which is supported by an organic layer such as extremely thin collodion or Formvar, is preferably employed. The more preferred carbon layer is prepared as follows. The carbon layer is formed on a rock salt substrate which is removed through dissolution. Alternately, the organic layer is removed employing organic solvents and ion etching whereby the carbon layer itself is obtained. The acceleration voltage applied to the TEM is preferably from 80 to 400 kV, and is more preferably from 80 to 200 kV.

Other items such as electron microscopic observation techniques, as well as sample preparation techniques, may be obtained while referring to either "Igaku-Seibutsugaku Denshikenbikyo Kansatsu Gihoh (Medical-Biological Electron Microscopic Observation Techniques", edited by Nippon Denshikembikyo Gakkai Kanto Shibu (Maruzen) or "Denshikembikyo Seibutsu Shiryo Sakuseihoh (Preparation Methods of Electron Microscopic Biological Samples", edited by Nippon Denshikenbikyo Gakkai Kanto Shibu (Maruzen).

It is preferable that a TEM image, recorded in a suitable medium, is decomposed into preferably at least 1,024×1,024 pixels and into more preferably 2,048×2,048 pixels, and subsequently subjected to image processing, utilizing a computer. In order to carry out the image processing, it is preferable that an analogue image, recorded on a film strip, is converted into a digital image, employing any appropriate means such as scanner, and if desired, the resulting digital image is subjected to shading correction as well as contrast-edge enhancement. Thereafter, a histogram is prepared, and portions, which correspond to aliphatic carboxylic acid silver salts, are extracted through a binarization processing.

At least 300 of the thickness of aliphatic carboxylic acid silver salt particles, extracted as above, are manually determined employing appropriate software, and an average value is then obtained.

Methods to prepare aliphatic carboxylic acid silver salt particles, having the shape as above, are not particularly limited. It is preferable to maintain a mixing state during formation of an organic acid alkali metal salt soap and/or a mixing state during addition of silver nitrate to the soap as desired, and to optimize the proportion of organic acid to the soap, and of silver nitrate which reacts with the soap.

It is preferable that, if desired, the planar aliphatic carboxylic acid silver salt particles (referring to aliphatic carboxylic acid silver salt particles, having an average circle equivalent diameter of 0.05 to 0.80 μm as well as an average thickness of 0.005 to 0.070 μm) are preliminarily dispersed together with binders as well as surface active agents, and thereafter, the resultant mixture is dispersed employing a media homogenizer or a high pressure homogenizer. The preliminary dispersion may be carried out employing a common anchor type or propeller type stirrer, a high speed rotation centrifugal radial type stirrer (being a dissolver), and a high speed rotation shearing type stirrer (being a homomixer).

Further, employed as the aforesaid media homogenizers may be rotation mills such as a ball mill, a planet ball mill, and a vibration ball mill, media stirring mills such as a bead mill and an attritor, and still others such as a basket mill. Employed as high pressure homogenizers may be various types such as a type in which collision against walls and plugs occurs, a type in which a liquid is divided into a plurality of portions which are collided with each other at high speed, and a type in which a liquid is passed through narrow orifices.

Preferably employed as ceramics, which are used in ceramic beads employed during media dispersion are, for example, yttrium-stabilized zirconia, and zirconia-reinforced alumina (hereafter ceramics containing zirconia are abbreviated to as zirconia). The reason of the preference is that impurity formation due to friction with beads as well as the homogenizer during dispersion is minimized.

In apparatuses which are employed to disperse the planar aliphatic carboxylic acid silver salt particles of the present invention, preferably employed as materials of the members which come into contact with the aliphatic carboxylic acid silver salt particles are ceramics such as zirconia, alumina, silicon nitride, and boron nitride, or diamond. Of these, zirconia is preferably employed. During the dispersion, the concentration of added binders is preferably from 0.1 to 10.0 percent by weight with respect to the weight of aliphatic carboxylic acid silver salts. Further, temperature of the dispersion during the preliminary and main dispersion is preferably maintained at not more than 45° C. The examples of the preferable operation conditions for the main dispersion are as follows. When a high pressure homogenizer is employed as a dispersion means, preferable operation conditions are from 29 to 100 MPa, and at least double operation frequency. Further, when the media homogenizer is employed as a dispersion means, the peripheral rate of 6 to 13 m/second is cited as the preferable condition.

In the present invention, light-insensitive aliphatic carboxylic acid silver salt particles are preferably formed in the presence of compounds which function as a crystal growth retarding agent or a dispersing agent. Further, the compounds which function as a crystal growth retarding agent or a dispersing agent are preferably organic compounds having a hydroxyl group or a carboxyl group.

In the present invention, compounds, which are described herein as crystal growth retarding agents or dispersing agents for aliphatic carboxylic acid silver salt particles, refer to compounds which, in the production process of aliphatic carboxylic acid silver salts, exhibit more functions and greater effects to decrease the grain diameter, and to enhance monodispersibility when the aliphatic carboxylic acid silver salts are prepared in the presence of the compounds, compared to the case in which the compounds are not employed. Listed as examples are monohydric alcohols having 10 or fewer carbon atoms, such as preferably secondary alcohol and tertiary alcohol; glycols such as ethylene glycol and propylene glycol; polyethers such as polyethylene glycol; and glycerin. The preferable addition amount is from 10 to 200 percent by weight with respect to aliphatic carboxylic acid silver salts.

On the other hands, preferred are branched aliphatic carboxylic acids, each containing an isomer, such as isoheptanic acid, isodecanoic acid, isotridecanoic acid, isomyristic acid, isopalmitic acid, isostearic acid, isoarachidinic acid, isobehenic acid, or isohexaconic acid. Listed as preferable side chains are an alkyl group or an alkenyl group having 4 or fewer carbon atoms. Further, listed are aliphatic unsaturated carboxylic acids such as palmitoleic acid, oleic acid, linoleic acid, linolenic acid, moroctic acid, eicosenoic acid, arachidonic acid, eicosapentaenoic acid, erucic acid, docosapentaenoic acid, and selacholeic acid. The preferable addition amount is from 0.5 to 10.0 mol percent of aliphatic carboxylic acid silver salts.

Preferable compounds include glycosides such as glucoside, galactoside, and fructoside; trehalose type disaccharides such as trehalose and sucrose; polysaccharides such as glycogen, dextrin, dextran, and alginic acid; cellosolves such as methyl cellosolve and ethyl cellosolve; water-soluble organic solvents such as sorbitan, sorbitol, ethyl acetate, methyl acetate, and dimethylformamide; and water-soluble polymers such as polyvinyl alcohol, polyacrylic acid, acrylic acid copolymers, maleic acid copolymers, carboxymethyl cellulose, hydroxypropyl cellulose, hydroxypropyl methyl cellulose, polyvinylpyrrolidone, and gelatin. The preferable addition amount is from 0.1 to 20.0 percent by weight with respect to aliphatic carboxylic acid silver salts.

Alcohols having 10 or fewer carbon atoms, being preferably secondary alcohols and tertiary alcohols, increase the solubility of sodium aliphatic carboxylates in the emulsion preparation process, whereby the viscosity is lowered so as to enhance the stirring efficiency and to enhance monodispersibility as well as to decrease particle size. Branched aliphatic carboxylic acids, as well as aliphatic unsaturated carboxylic acids, result in higher steric hindrance than straight chain aliphatic carboxylic acid silver salts as a main component during crystallization of aliphatic carboxylic acid silver salts to increase the distortion of crystal lattices whereby the particle size decreases due to non-formation of over-sized crystals.

<Antifoggant and Image Stabilizer>

As mentioned above, being compared to conventional silver halide photosensitive photographic materials, the greatest different point in terms of the structure of silver salt photothermographic dry imaging materials is that in the latter materials, a large amount of photosensitive silver halide, organic silver salts and reducing agents is contained which are capable of becoming causes of generation of fogging and printout silver, irrespective of prior and after photographic processing. Due to that, in order to maintain storage stability before development and even after development, it is imprtant to apply highly effective fog minimizing and image stabilizing techniques to silver salt photothermographic dry imaging materials. Other than aromatic heterocyclic compounds which retard the growth and development of fog specks, heretofore, mercury compounds, such as mercury acetate, which exhibit functions to oxidize and eliminate fog specks, have been employed as a markedly effective storage stabilizing agents. However, the use of such mercury compounds may cause problems regarding safety as well as environmental protection.

The important points for achieving technologies for antifogging and image stabilizing are:

to prevent formation of metallic silver or silver atoms caused by reduction of silver ion during preserving the material prior to or after development; and to prevent the formed silver from effecting as a catalyst for oxidation (to oxidize silver into silver ions) or reduction (to reduce silver ions to silver).

Antifoggants as well as image stabilizing agents which are employed in the silver salt photothermographic dry imaging material of the present invention will now be described.

In the silver salt photothermographic dry imaging material of the present invention, one of the features is that bisphenols are mainly employed as a reducing agent, as described below. It is preferable that compounds are incorporated which are capable of deactivating reducing agents upon generating active species capable of extracting hydrogen atoms from the aforesaid reducing agents.

Preferred compounds are those which are capable of: preventing the reducing agent from forming a phenoxy radial; or trapping the formed phenoxy radial so as to stabilize the phenoxy radial in a deactivated form to be effective as a reducing agent for silver ions.

Preferred compounds having the above-mentioned properties are non-reducible compounds having a functional group capable of forming a hydrogen bonding with a hydroxyl group in a bis-phenol compound. Examples are compounds having in the molecule such as, a phosphoryl group, a sulfoxide group, a sulfonyl group, a carbonyl group, an amido group, an ester group, a urethane group, a ureido group, a tertiary amino group, or a nitrogen containing aromatic group.

More preferred are compounds having a sulfonyl group, a sulfoxide group or a phosphoryl group in the molecule.

Specific examples are disclosed in, Japanese Patent O.P.I. Publication Nos. 6-208192, 20001-215648, 3-50235, 2002-

6444, 2002-18264. Another examples having a vinyl group are disclosed in, Japanese translated PCT Publication No. 2000-515995, Japanese Patent O.P.I. Publication Nos. 2002-207273, and 2003-140298.

Further, it is possible to simultaneously use compounds capable of oxidizing silver (metallic silver) such as compounds which release a halogen radical having oxidizing capability, or compounds which interact with silver to form a charge transfer complex. Specific examples of compounds which exhibit the aforesaid function are disclosed in Japanese Patent O.P.I. Publication Nos. 50-120328, 59-57234, 4-232939, 6-208193, and 10-197989, as well as U.S. Pat. No. 5,460,938, and Japanese Patent O.P.I. Publication No. 7-2781. Specifically, in the imaging materials according to the present invention, specific examples of preferred compounds include halogen radical releasing compounds which are represented by General Formula (OFI) below.

$$Q_2\text{-}Y\text{—}C(X_1)(X_3)(X_2) \qquad \text{General Formula (OFI)}$$

In General Formula (OFI), $Q_2$ represents an aryl group or a heterocyclic group; $X_1$, $X_2$, and $X_3$ each represent a hydrogen atom, a halogen atom, an acyl group, an alkoxycarbonyl group, an aryloxycarbonyl group, a sulfonyl group, or an aryl group, at least one of which is a halogen atom; and Y represents —C(═O)—, —SO— or —$SO_2$—.

The added amount of compounds, represented by General Formula (OFI), is commonly $1\times10^{-4}$–1 mol per mol of silver, and is preferably $1\times10^{-3}$–$5\times10^{-2}$ mol.

Incidentally, in the imaging materials according to the present invention, it is possible to use those disclosed in Japanese Patent O.P.I. Publication No. 2003-5041 in the manner as the compounds represented by aforesaid General Formula (OFI). Specific examples of the compounds represented by General Formula (OFI) include OFI-1 to 63 described in paragraph Nos. [0128]–[0135] of Japanese Patent Application No. 2003-320555 (Japanese Patent O.P.I. Publication 2005-107496).

(Polymer PO Inhibitors)

Further, in view of the capability of more stabilizing of silver images, as well as an increase in photographic speed and CP, it is preferable to use, in the photothermographic imaging materials according to the present invention, as an image stabilizer, polymers which have at least one repeating unit of the monomer having a radical releasing group disclosed in Japanese Patent O.P.I. Publication No. 2003-91054. Specifically, in the photothermographic imaging materials according to the present invention, desired results are unexpectedly obtained. Specific examples of polymers having a halogen radical releasing group include XP-1 to 10 described in paragraph Nos. [0138]–[0141] of Japanese Patent Application No. 2003-320555 (Japanese Patent O.P.I. Publication No. 2005-107496).

Incidentally, other than the above-mentioned compounds, compounds which are conventionally known as an antifogging agent may be incorporated in the silver salt photothermographic dry imaging materials of the present invention. For example, listed are the compounds described in U.S. Pat. Nos. 3,589,903, 4,546,075, 4,452,885, 3,874,946 and 4,756,999, and Japanese Patent O.P.I. Publication Nos. 59-57234, 9-288328 and 9-90550. Listed as other antifogging agents are compounds disclosed in U.S. Pat. No. 5,028,523, and European Patent Nos. 600,587, 605,981 and 631,176.

<Polycarboxyl Compounds>

In the imaging materials according to the present invention, it is preferable to use the compounds represented by the following General Formula (PC) as an antifogging agent and a storage stabilizer.

$$R\text{—}(CO\text{—}O\text{-}M_1)_n \qquad \text{General Formula (PC)}$$

wherein R represents a linkable atom, an aliphatic group, an aromatic group, a heterocyclic group, or a group of atoms capable of forming a ring as they combine with each other; $M_1$ represents a hydrogen atom, a metal atom, a quaternary ammonium group, or a phosphonium group; and n represents an integer of 2–20.

Yet further, when General Formula (PC) is an oligomer or a polymer $(R\text{—}(COOM_1)_{n1})_{m1}$ desired effects are obtained, wherein n1 is preferably 2–20, and m1 is preferably 1–100, or the molecular weight is preferably at most 50,000.

Acid anhydrides of General Formula (PC) effectively used, as described in the present invention, refer to compounds which are formed in such a manner that two carboxyl groups of the compound represented by General Formula (PC) undergo dehydration reaction. Acid anhydrides are preferably prepared from compounds having 3–10 carboxyl groups and derivatives thereof.

Further preferably employed are simultaneously dicarboxylic acids described in Japanese Patent O.P.I. Publication Nos. 58-95338, 10-288824, 11-174621, 11-218877, 2000-10237, 2000-10236, 2000-10235, 2000-10233, 2000-10232 and 2000-10231.

<Thiosulfonic Acid Restrainers>

It is preferable that imaging materials according to the present invention contain the compounds represented by aforesaid General Formula (ST).

$$Z\text{-}SO_2.S\text{-}M_2 \qquad \text{General Formula (ST)}$$

wherein Z represents an unsubstituted or substituted alkyl group, an aryl group or a heterocyclic group; and $M_2$ represents a metal atom or an organic cation.

Specific examples of the compounds represented by General Formula (ST) include ST-1 to 40 described in paragraph Nos. [0155]–[0157] of Japanese Patent Application No. 2003-320555 (Japanese Patent O.P.I. Publication 2005-107496).

The compounds represented by General Formula (ST) may be added at any time prior to the coating process of the production process of the imaging materials according to the present invention. However, it is preferable that they are added to a liquid coating composition just before the coating.

The added amount of the compounds represented by General Formula (ST) is not particularly limited, but is preferably in the range of $1\times10^{-6}$–1 g per mol of the total silver amount, including silver halides.

Incidentally, similar compounds are disclosed in Japanese Patent O.P.I. Publication No. 8-314059.

<Electron Attractive Group Containing Vinyl Type Restrainers>

In the present invention, it is preferable to simultaneously use the fog restrainers represented by aforesaid General Formula (CV) described in Japanese Patent Application No.

2003-320555 (Japanese Patent O.P.I. Publication 2005-107496).

General Formula (CV)

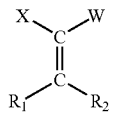

In General Formula (CV), X represents an electron attractive group, and W includes a hydrogen atom, an alkyl group, an alkenyl group, an alkynyl group, an aryl group, a heterocyclic group, a halogen atom, a cyano group, an acyl group, a thioacyl group, an oxalyl group, an oxyoxalyl group, a —S-oxalyl group, an oxamoyl group, an oxycarbonyl group, a —S-carbonyl group, a carbamoyl group, a thiocarbamoyl group, a sulfonyl group, a sulfinyl group, an oxysulfonyl group, a —S-sulfonyl group, a sulfamoyl group, an oxysulfinyl group, a —S-sulfinyl group, a sulfinamoyl group, a phosphoryl group, a nitro group, an imino group, a N-carbonylimino group, N-sulfonylimino group, an ammonium group, a sulfonium group, a phosphonium group, a pyrilium group and an immonium group. $R_1$ represents a hydroxyl group or salts of the hydroxyl group, and $R_2$ represents an alkyl group, an alkenyl group, an alkynyl group, an aryl group or a heterocyclic group. X and W may form a ring structure by bonding to each other. X and $R_1$ may be a cis-form or a trans-form.

Specific examples of the compounds represented by General Formula (CV) include CV-1 to 136 described in paragraph Nos. [0192]–[0203] of Japanese Patent Application No. 2003-320555 (Japanese Patent O.P.I. Publication 2005-107496).

The compound represented by General Formula (CV) is incorporated at least in one of a light-sensitive layer and light-insensitive layers on said light-sensitive layer side, of a thermally developable light-sensitive material, and preferably at least in a light-sensitive layer. The addition amount of compounds represented by General Formula (1) is preferably $1\times10^{-8}$–1 mol/Ag mol, more preferably $1\times10^{-6}$–$1\times10^{-1}$ mol/Ag mol and most preferably $1\times10^{-4}$–$1\times10^{-2}$ mol/Ag mol.

The compound represented by General Formula (CV) can be added in a light-sensitive layer or a light-insensitive layer according to commonly known methods. That is, they can be added in light-sensitive layer or light-insensitive layer coating solution by being dissolved in alcohols such as methanol and ethanol, ketones such as methyl ethyl ketone and acetone, and polar solvents such as dimethylsulfoxide and dimethylformamide. Further, they can be added also by being made into micro-particles of not more than 1 μm followed by being dispersed in water or in an organic solvent. As for microparticle dispersion techniques, many techniques have been disclosed and the compound can be dispersed according to these techniques.

<Silver Ion Reducing Agents>

In the present invention, employed as a silver ion reducing agent (hereinafter occasionally referred simply to as a reducing agent) may be polyphenols described in U.S. Pat. Nos. 3,589,903 and 4,021,249, British Patent No. 1,486,148, Japanese Patent O.P.I. Publication Nos. 51-51933, 50-36110, 50-116023, and 52-84727, and Japanese Patent Publication No. 51-35727; bisnaphthols such as 2,2'-dihydroxy-1,1'-binaphthyl and 6,6'-dibromo-2,2'-dihydroxy-1,1'-binaphthyl described in U.S. Pat. No. 3,672,904; sulfonamidophenols and sulfonamidonaphthols such as 4-benzenesulfonamidophenol, 2-benznesulfonamidophenol, 2,6-dichloro-4-benenesulfonamidophenol, and 4-benznesulfonamidonaphthol described in U.S. Pat. No. 3,801,321.

In the present invention, preferred reducing agents for silver ions are compounds represented by the aforesaid General Formula (RED).

General Formula (RED)

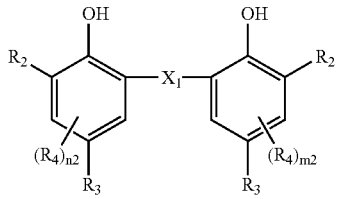

wherein $X_1$ represents a chalcogen atom or $CHR_1$, $R_1$ being a hydrogen atom, a halogen atom, an alkyl group, an alkenyl group, an aryl group or a heterocyclic group; $R_2$ represents an alkyl group; $R_3$ represents a hydrogen atom or a substituent capable of substituting a hydrogen atom on a benzene ring; $R_4$ represents a substituent; and, m2 and n2 each represents an integer of 0 to 2.

Specific examples of the compounds represented by General Formula (RED) include RED-1 to 21 described in paragraph Nos. [0226]–[0228] of Japanese Patent Application No. 2003-320555 (Japanese Patent O.P.I. Publication 2005-107496).

The amount of silver ion reducing agents employed in the photothermographic dry imaging materials of the present invention varies depending on the types of organic silver salts, reducing agents and other additives. However, the aforesaid amount is customarily 0.05–10 mol per mol of organic silver salts, and is preferably 0.1–3 mol. Further, in the aforesaid range, silver ion reducing agents of the present invention may be employed in combinations of at least two types. Namely, in view of achieving images exhibiting excellent storage stability, high image quality and high CP, it is preferable to simultaneously use reducing agents which differ in reactivity, due to a different chemical structure.

In the present invention, preferred cases occasionally occur in which the aforesaid reducing agents are added, just prior to coating, to a photosensitive emulsion composed of photosensitive silver halide, organic silver salt particles, and solvents and the resulting mixture is coated to minimize variations of photographic performance due to the standing time.

Further, hydrazine derivatives and phenol derivatives represented by General Formulas (1)–(4) in Japanese Patent O.P.I. Publication No. 2003-43614, and General Formulas (1)–(3) in Japanese Patent O.P.I. Publication No. 2003-66559 are preferably employed as a development accelerator which are simultaneously employed with the aforesaid reducing agents.

Further employed as silver ion reducing agents according to the present invention may be various types of reducing agents disclosed in European Patent No. 1,278,101 and Japanese Patent O.P.I. Publication No. 2003-15252.

The amount of silver ion reducing agents employed in the photothermogtaphic imaging materials of the present invention varies depending on the types of organic silver salts, reducing agents, and other additives. However, the aforesaid amount is customarily 0.05–10 mol per mol of organic silver salts and is preferably 0.1–3 mol. Further, in this amount range, silver ion reducing agents of the present invention may be employed in combinations of at least two types. Namely, in view of achieving images exhibiting excellent storage stability, high image quality, and high CP, it is preferable to simultaneously employ reducing agents which differ in reactivity due to different chemical structure.

In the present invention, preferred cases occasionally occur in which when the aforesaid reducing agents are added to and mixed with a photosensitive emulsion composed of photosensitive silver halide, organic silver salt particles, and solvents just prior to coating, and then coated, variation of photographic performance during standing time is minimized.

<Chemical Sensitization>

The photosensitive silver halide of the present invention may undergo chemical sensitization. For instance, it is possible to create chemical sensitization centers (being chemical sensitization nuclei) utilizing compounds which release chalcogen such as sulfur, as well as noble metal compounds which release noble metals ions, such as gold ions, while employing methods described in, for example, Japanese Patent O.P.I. Publication Nos. 2001-249428 and 2001-249426. The chemical sensitization nuclei is capable of trapping an electron or a hole produced by a photoexcitation of a sensitizing dye. It is preferable that the aforesaid silver halide is chemically sensitized employing organic sensitizers containing chalcogen atoms.

It is preferable that the aforesaid organic sensitizers, comprising chalcogen atoms, have a group capable of being adsorbed onto silver halide grains as well as unstable chalcogen atom positions.

Employed as the aforesaid organic sensitizers may be those having various structures, as disclosed in Japanese Patent O.P.I. Publication Nos. 60-150046, 4-109240, 11-218874, 11-218875, 11-218876, and 11-194447. Of these, the aforesaid organic sensitizer is preferably at least one of compounds having a structure in which the chalcogen atom bonds to a carbon atom, or to a phosphorus atom, via a double bond. More specifically, a thiourea derivative having a heterocylic group and a triphenylphosphine derivative are preferred.

Chemical sensitization methods of the present invention can be applied based on a variety of methods known in the field of wet type silver halide materials. Examples are disclosed in: (1) T. H. James ed., "The Theory of the Photographic Process" $4^{th}$ edition, Macmillan Publishing Co., Ltd. 1977; and (2) Japan Photographic Society, "Shashin Kogaku no Kiso" (Basics of Photographic Engineering), Corona Publishing, 1998. Specifically, when a silver halide emulsion is chemically sensitized, then mixed with a light-insensitive organic silver salt, the conventionally known chemical sensitizing methods ca be applied.

The employed amount of chalcogen compounds as an organic sensitizer varies depending on the types of employed chalcogen compounds, silver halide grains, and reaction environments during performing chemical sensitization, but is preferably from $10^{-8}$ to $10^{-2}$ mol per mol of silver halide, and is more preferably from $10^{-7}$ to $10^{-3}$ mol. The chemical sensitization environments are not particularly limited. However, it is preferable that in the presence of compounds which diminish chalcogenized silver or silver nuclei, or decrease their size, especially in the presence of oxidizing agents capable of oxidizing silver nuclei, chalcogen sensitization is performed employing organic sensitizers, containing chalcogen atoms. The sensitization conditions are that the pAg is preferably from 6 to 11, but is more preferably from 7 to 10, while the pH is preferably from 4 to 10, but is more preferably from 5 to 8. Further, the sensitization is preferably carried out at a temperature of not more than 30° C.

Further, it is preferable that chemical sensitization, employing the aforesaid organic sensitizers, is carried out in the presence of either spectral sensitizing dyes or compounds containing heteroatoms, which exhibit the adsorption onto silver halide grains. By carrying out chemical sensitization in the presence of compounds which exhibit adsorption onto silver halide grains, it is possible to minimize the dispersion of chemical sensitization center nuclei, whereby it is possible to achieve higher speed as well as lower fogging. Though spectral sensitizing dyes will be described below, the compounds comprising heteroatoms, which result in adsorption onto silver halide grains, as descried herein, refer to, as preferable examples, nitrogen containing heterocyclic compounds described in JP-A No. 3-24537. Listed as heterocycles in nitrogen-containing heterocyclic compounds may be a pyrazole ring, a pyrimidine ring, a 1,2,4-triazine ring, a 1,2,3-triazole ring, a 1,3,4-thiazole ring, a 1,2,3-thiazole ring, a 1,2,4-thiadiazole ring, a 1,2,5-thiadiazole ring, 1,2,3,4-tetrazole ring, a pyridazine ring, and a 1,2,3-triazine ring, and a ring which is formed by combining 2 or 3 of the rings such as a triazolotriazole ring, a diazaindene ring, a triazaindene ring, and a pentaazaindenes ring. It is also possible to employ heterocyclic rings such as a phthalazine ring, a benzimidazole ring, an indazole ring and a benzthiazole ring, which are formed by condensing a single heterocyclic ring and an aromatic ring.

Of these, preferred is an azaindene ring. Further, preferred are azaindene compounds having a hydroxyl group, as a substituent, which include compounds such as hydroxytriazaindene, tetrahydroxyazaindene, and hydroxypentaazaindene.

The aforesaid heterocyclic ring may have substituents other than a, hydroxyl group. As substituents, the aforesaid heterocyclic ring may have, for example, an alkyl group, a substituted alkyl group, an alkylthio group; an amino group, a hydroxyamino group, an alkylamino group, a dialkylamino group, an arylamino group, a carboxyl group, an alkoxycarbonyl group, a halogen atom, and a cyano group.

The added amount of these heterocyclic compounds varies widely depending on the size and composition of silver halide grains, and other conditions. However, the amount is in the range of about $10^{-6}$ to 1 mol per mol with respect to silver halide, and is preferably in the range of $10^{-4}$ to $10^{-1}$ mol.

The photosensitive silver halide of the present invention may undergo noble metal sensitization utilizing compounds which release noble metal ions such as gold ions. For example, employed as gold sensitizers may be chloroaurates and organic gold compounds disclosed in Japanese Patent O.P.I. Publication No. 11-194447.

Further, other than the aforesaid sensitization methods, it is possible to employ a reduction sensitization method. Employed as specific compounds for the reduction sensitization may be ascorbic acid, thiourea dioxide, stannous chloride, hydrazine derivatives, boron compounds, silane compounds, and polyamine compounds. Further, it is possible to perform reduction sensitization by ripening an emulsion while maintaining a pH not less than 7 or a pAg not more than 8.3.

Silver halide which undergoes the chemical sensitization, according to the present invention, includes one which has been formed in the presence of organic silver salts, another which has been formed in the absence of organic silver salts, or still another which has been formed by mixing those above.

In the present invention, it is preferable that the surface of photosensitive silver halide grains undergoes chemical sensitization and the resulting chemical sensitizing effects are substantially lost after the thermal development process. "Chemical sensitization effects are substantially lost after the thermal development process", as described herein, means that the speed of the aforesaid imaging material which has been achieved by the aforesaid chemical sensitization techniques decreases to 1.1 times or less compared to the speed of aforesaid material which does not undergo chemical sensitization.

In order to decrease the effect of chemical sensitization after thermal development treatment, it is preferred to incorporate sufficient amount of an oxidizing agent capable to destroy the center of chemical sensitization by oxidation in an photosensitive emulsion layer or non-photosensitive layer of the imaging material. An example of such compound is a aforementioned compound which release a halogen radical. An amount of incorporated oxidizing agent is preferably adjusted by considering an oxidizing power of the oxidizing agent and the degree of the decrease the effect of chemical sensitization.

<Spectral Sensitization>

It is preferable that photosensitive silver halide in the present invention is adsorbed by spectral sensitizing dyes so as to result in spectral sensitization. Employed as spectral sensitizing dyes may be cyanine dyes, merocyanine dyes, complex cyanine dyes, complex merocyanine dyes, homopolar cyanine dyes, styryl dyes, hemicyanine dyes, oxonol dyes, and hemioxonol dyes. For example, employed may be sensitizing dyes described in Japanese Patent O.P.I. Publication Nos. 63-159841, 60-140335, 63-231437, 63-259651, 63-304242, and 63-15245, and U.S. Pat. Nos. 4,639,414, 4,740,455, 4,741,966, 4,751,175, and 4,835,096.

Useful sensitizing dyes, employed in the present invention, are described in, for example, Research Disclosure, Item 17645, Section IV-A (page 23, December 1978) and Item 18431, Section X (page 437, August 1978) and publications further cited therein. It is specifically preferable that those sensitizing dyes are used which exhibit spectral sensitivity suitable for spectral characteristics of light sources of various types of laser imagers, as well as of scanners. For example, preferably employed are compounds described in Japanese Patent O.P.I. Publication Nos. 9-34078, 9-54409, and 9-80679.

Useful cyanine dyes include, for example, cyanine dyes having basic nuclei such as a thiazoline nucleus, an oxazoline nucleus, a pyrroline nucleus, a pyridine nucleus, an oxazole nucleus, a thiazole nucleus, a selenazole nucleus, and an imidazole nucleus. Useful merocyanine dyes, which are preferred, comprise, in addition to the basic nuclei, acidic nuclei such as a thiohydantoin nucleus, a rhodanine nucleus, an oxazolizinedione nucleus, a thiazolinedione nucleus, a barbituric acid nucleus, a thiazolinone nucleus, a maronitryl nucleus, and a pyrazolone nucleus.

In the present invention, it is possible to employ sensitizing dyes which exhibit spectral sensitivity, specifically in the infrared region. Listed as preferably employed infrared spectral sensitizing dyes are infrared spectral sensitizing dyes disclosed in U.S. Pat. Nos. 4,536,473, 4,515,888, and 4,959,294.

It is preferred that the imaging material of the present invention incorporates at least one sensitizing dye represented by the following General Formulas (SD-1) or (SD-2) described in Japanese Patent Application No. 2003-320555 (Japanese Patent O.P.I. Publication 2005-107496).

General Formula (SD-1)

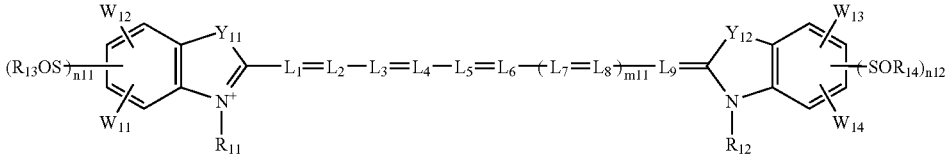

General Formula (SD-2)

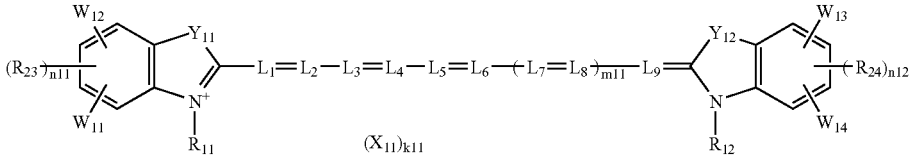

wherein $Y_{11}$ and $Y_{12}$ each represent an oxygen atom, a sulfur atom, a selenium atom, or —CH=CH—; $L_1$–$L_9$ each represent a methine group; $R_{11}$ and $R_{12}$ each represent an aliphatic group; $R_{13}$, $R_{14}$, $R_{23}$, and $R_{24}$ each represent a lower alkyl group, a cycloalkyl group, an alkenyl group, an aralkyl group, an aryl group, or a heterocyclic group; $W_{11}$, $W_{12}$, $W_{13}$, and $W_{14}$ each represent a hydrogen atom, a substituent, or a group of non-metallic atoms necessary for forming a condensed ring while combined between $W_{11}$ and $W_{12}$ and $W_{13}$ and $W_{14}$ or represent a group of non-metallic atoms necessary for forming a 5- or 6-membered condensed ring while combined between $R_{13}$ and $W_{11}$, $R_{13}$ and $W_{12}$, $R_{23}$ and $W_{11}$, $R_{23}$ and $W_{12}$, $R_{14}$ and $W_{13}$, $R_{14}$ and $W_{14}$, $R_{24}$ and $W_{13}$, or $R_{24}$ and $W_{14}$; $X_{11}$ represents an ion necessary for neutralizing the charge in the molecule; $k_{11}$ represents the number of ions necessary for neutralizing the charge in the molecule; m11 represents 0 or 1; and n11 and n12 each represent 0, 1, or 2, however, n11 and n12 should not represent 0 at the same time.

It is possible to easily synthesize the aforesaid infrared sensitizing dyes, employing the method described in F. M. Harmer, "The Chemistry of Heterocyclic Compounds, Volume 18, The Cyanine Dyes and Related Compounds (A. Weissberger ed., published by Interscience, New York, 1964).

These infrared sensitizing dyes may be added at any time after preparing the silver halide. For example, the dyes may be added to solvents, or the dyes, in a so-called solid dispersion state in which the dyes are dispersed into minute particles, may be added to a photosensitive emulsion comprising silver halide grains or silver halide grains/aliphatic carboxylic acid silver salts. Further, in the same manner as the aforesaid heteroatoms containing compounds which exhibit adsorption onto silver halide grains, the dyes are adsorbed onto silver halide grains prior to chemical sensitization, and subsequently, undergo chemical sensitization, whereby it is possible to minimize the dispersion of chemical sensitization center nuclei so at to enhance speed, as well as to decrease fogging.

In the present invention, the aforesaid spectral sensitizing dyes may be employed individually or in combination. Combinations of sensitizing dyes are frequently employed when specifically aiming for supersensitization, for expanding or adjusting a spectral sensitization range.

An emulsion comprising photosensitive silver halide as well as aliphatic carboxylic acid silver salts, which are employed in the silver salt photothermographic dry imaging material of the present invention, may comprise sensitizing dyes together with compounds which are dyes having no spectral sensitization or have substantially no absorption of visible light and exhibit supersensitization, whereby the aforesaid silver halide grains may be supersensitized.

Useful combinations of sensitizing dyes and dyes exhibiting supersensitization, as well as materials exhibiting supersensitization, are described in Research Disclosure Item 17643 (published December 1978), page 23, Section J of IV; Japanese Patent Publication Nos. 9-25500 and 43-4933; and Japanese Patent O.P.I. Publication Nos. 59-19032, 59-192242, and 5-431432. Preferred as supersensitizers are hetero-aromatic mercapto compounds or mercapto derivatives.

$Ar\text{-}SM_3$ wherein $M_3$ represents a hydrogen atom or an alkali metal atom, and Ar represents an aromatic ring or a condensed aromatic ring, having at least one of a nitrogen, sulfur, oxygen, selenium, or tellurium atom. Hetero-aromatic rings are preferably benzimidazole, naphthoimidazole, benzimidazole, naphthothiazole, benzoxazole, naphthooxazole, benzoselenazole, benztellurazole, imidazole, oxazole, pyrazole, triazole, triazine, pyrimidine, pyridazine, pyrazine, pyridine, purine, quinoline, or quinazoline. On the other hand, other hetero-aromatic rings are also included.

Incidentally, mercapto derivatives, when incorporated in the dispersion of aliphatic carboxylic acid silver salts and/or a silver halide grain emulsion, are also included which substantially prepare the mercapto compounds. Specifically, listed as preferred examples are the mercapto derivatives described below.

Ar-S—S-Ar wherein Ar is the same as the mercapto compounds defined above.

The aforesaid hetero-aromatic rings may have a substituent selected from the group consisting of, for example, a halogen atom (for example, Cl, Br, and I), a hydroxyl group, an amino group, a carboxyl group, an alkyl group (for example, an alkyl group having at least one carbon atom and preferably having from 1 to 4 carbon atoms), and an alkoxy group (for example, an alkoxy group having at least one carbon atom and preferably having from 1 to 4 carbon atoms).

Other than the aforesaid supersensitizers, large ring compounds containing a hetero atom disclosed in Japanese Patent O.P.I. Publication No. 2001-330918 can be used as supersensitizers.

The amount of a supersensitizer of the present invention used in a photosensitive layer containing an organic silver salt and silver halide grains and in the present invention is in the range of 0.001 to 1.0 mol per mol of Ag. More preferably, it is 0.01, to 0.5 mol per mol of Ag.

In the present invention, it is preferable that the surface of photosensitive silver halide grains undergoes chemical sensitization and the resulting chemical sensitizing effects are substantially lost after the thermal development process. "Chemical sensitization effects are substantially lost after the thermal development process", as described herein, means that the speed of the aforesaid imaging material which has been achieved by the aforesaid chemical sensitization techniques decreases to 1.1 times or less compared to the speed of aforesaid material which does not undergo chemical sensitization. In order to decrease the effect of chemical sensitization after thermal development treatment, it is preferred to incorporate sufficient amount of an oxidizing agent capable to destroy the center of chemical sensitization by oxidation in an photosensitive emulsion layer or non-photosensitive layer of the imaging material. An example of such compound is a aforementioned compound which release a halogen radical. An amount of incorporated oxidizing agent is preferably adjusted by considering an oxidizing power of the oxidizing agent and the degree of decreasing the effect of chemical sensitization.

<Silver Saving Agent>

In the present invention, either a photosensitive layer or a light-insensitive layer may comprise silver saving agents.

The silver saving agents, used in the present invention, refer to compounds capable of reducing the silver amount to obtain a definite silver image density. Even though various mechanisms may be considered to explain functions regarding a decrease in the silver amount, compounds having functions to enhance covering power of developed silver are preferable. The covering power of developed silver, as described herein, refers to optical density per unit amount of silver. These silver saving agents may be incorporated in either a photosensitive layer or a light-insensitive layer or in both such layers.

Listed as preferred examples of silver saving agents are hydrazine derivatives represented by General Formula (H) described below, vinyl compounds represented by General Formula (G) described below, and quaternary onium compounds represented by General Formula (P) described below.

General Formula (H)

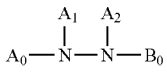

General Formula (G)

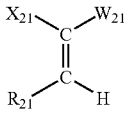

-continued

General Formula (P)

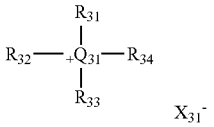

In General Formula (H), $A_0$ represents an aliphatic group, an aromatic group, a heterocyclic group, or a $-G_0-D_0$ group, each of which may have a substituent; $B_0$ represents a blocking group; and $A_1$ and $A_2$ each represents a hydrogen atom, or one represents a hydrogen atom and the other represents an acyl group, a sulfonyl group, or a oxalyl group. Herein, $G_0$ represents a —CO— group, a —COCO— group, a —CS— group, a —C((=$NG_1D_1$)— group, a —SO— group, a —$SO_2$— group, or a —P(O)($G_1D_1$)— group, wherein $G_1$ represents a simple bonding atom or a group such as an —O— group, a —S— group, or an —N($D_1$)— group, wherein $D_1$ represents an aliphatic group, an aromatic group, a heterocyclic group, or a hydrogen atom; when there is a plurality of $D_1$ in the molecule, those may be the same or different; and $D_0$ represents a hydrogen atom, an aliphatic group, an aromatic group, a heterocyclic group, an amino group, an alkoxy group, an aryloxy group, an alkylthio group, or an arylthio group. Listed as preferred $D_0$ are a hydrogen atom, an alkyl group, an alkoxy group, and an amino group.

In General Formula (G), $X_{21}$ as well as $R_{21}$ are illustrated utilizing a cis form, while $X_{21}$ and $R_{21}$ include a trans form. This is applied to the structure illustration of specific compounds.

In General Formula (G), $X_{21}$ represents an electron attractive group, while $W_{21}$ represents a hydrogen atom, an alkyl group, an alkenyl group, an alkynyl group, an aryl group, a heterocyclic group, a halogen atom, an acyl group, a thioacyl group, an oxalyl group, an oxyoxalyl group, a thioxyalyl group, an oxamoyl group, an oxycarbonyl group, a thiocarbonyl group, a carbamoyl group, a thiocarbamoyl group, a sulfonyl group, a sulfinyl group, an oxysulfinyl group, a thiosulfinyl group, a sulfamoyl group, an oxysulfinyl group, a thiosulfinyl group, a sulfamoyl group, a phosphoryl group, a nitro group, an imino group, an N-carbonylimino group, an N-sulfonylimino group, a dicyanoethylene group, an ammonium group, a sulfonium group, a phosphonium group, a pyrylium group, and an immonium group.

$R_{21}$ represents a halogen atom, a hydroxyl group, an alkoxy group, an aryloxy group, a heterocyclic oxy group, an alkenyloxy group, an acyloxy group, an alkoxycarbonyloxy group, an aminocarbonyloxy group, a mercapto group, an alkylthio group, an arylthio group, a heterocyclic thio group, an alkenylthio group, an acylthio group, an alkoxycarbonylthio group, an aminocarbonylthio group, a hydroxyl group, an organic or inorganic salt (for example, a sodium salt, a potassium salt, and a silver salt) of a mercapto group, an amino group, an alkylamino group, a cyclic amino group (for example, a pyrrolidino group), an acylamino group, an oxycarbonylamino group, a heterocyclic group (a nitrogen-containing 5- or 6-membered heterocyclic ring such as a benztriazolyl group, an imidazolyl group, a triazolyl group, and a tetrazolyl group), a ureido group, and a sulfonamido group. $X_{21}$ and $W_{21}$ may be joined together to form a ring structure, while $X_{21}$ and $R_{21}$ may also be joined together in the same manner. Listed as rings which are formed by $X_{21}$ and $W_{21}$ are, for example, pyrazolone, pyrazolidinone, cyclopentanedione, β-ketolactone, β-ketolactum.

In General Formula (P), $Q_{31}$ represents a nitrogen atom or a phosphorus atom; $R_{31}$, $R_{32}$, $R_{33}$, and $R_{34}$ each represents a hydrogen atom or a substituents; and $X_{31}^-$ represents an anion.

Incidentally, $R_{31}$ through $R_{34}$ may be joined together to form a ring.

The added amount of the aforesaid silver saving agents is commonly from $10^{-5}$ to 1 mol with respect to mol of aliphatic carboxylic acid silver salts, and is preferably from $10^{-4}$ to $5\times10^{-1}$ mol.

In the present invention, it is preferable that at least one of silver saving agents is a silane compound. The silane compounds employed as a silver saving agent in present invention are preferably alkoxysilane compounds having at least two primary or secondary amino groups or salts thereof, as described in Japanese Patent O.P.I. Publication No. 2003-5324.

When alkoxysilane compounds or salts thereof or Schiff bases are incorporated in the image forming layer as a silver saving agent, the added amount of these compound is preferably in the range of 0.00001 to 0.05 mol per mol of silver. Further, both of alkoxysilane compounds or salt thereof and Schiff bases are added, the added amount is in the same range as above.

<Binder>

Suitable binders for the silver salt photothermographic material of the present invention are to be transparent or translucent and commonly colorless, and include natural polymers, synthetic resin polymers and copolymers, as well as media to form film. The binders include, for example, gelatin, gum Arabic, casein, starch, poly(adrylic acid), poly(methacrylic acid), poly(vinyl chloride), poly(methacrylic acid), copoly(styrene-maleic anhydride), copoly(styrene-acrylonitrile), copoly(styrene-butadiene), poly(vinyl acetals) (for example, poly(vinyl formal) and poly(vinyl butyral), poly(esters), poly(urethanes), phenoxy resins, poly(vinylidene chloride), poly(epoxides), poly(carbonates), poly(vinyl acetate), cellulose esters, poly(amides). The binders may be hydrophilic or hydrophobic.

Preferable binders for the photosensitive layer of the silver salt photothermographic dry imaging material of the present invention are poly(vinyl acetals), and a particularly preferable binder is poly(vinyl butyral), which will be detailed hereunder. Polymers such as cellulose esters, especially polymers such as triacetyl cellulose, cellulose acetate butyrate, which exhibit higher softening temperature, are preferable for an overcoating layer as well as an undercoating layer, specifically for a light-insensitive layer such as a protective layer and a backing layer. Incidentally, if desired, the binders may be employed in combination of at least two types.

Such binders are employed in the range of a proportion in which the binders function effectively. Skilled persons in the art can easily determine the effective range. For example, preferred as the index for maintaining aliphatic carboxylic acid silver salts in a photosensitive layer is the proportion range of binders to aliphatic carboxylic acid silver salts of 15:1 to 1:2 and most preferably of 8:1 to 1:1. Namely, the binder amount in the photosensitive layer is preferably from 1.5 to 6 g/$m^2$, and is more preferably from 1.7 to 5 g/$m^2$. When the binder amount is less than 1.5 g/$m^2$, density of the unexposed portion markedly increases, whereby it occasionally becomes impossible to use the resultant material.

In the present invention, it is preferable that thermal transition point temperature, after development is at not less than 100° C., is from 46 to 200° C. and is more preferably from 70 to 105° C. Thermal transition point temperature, as described in the present invention, refers to the VICAT softening point or the value shown by the ring and ball method, and also refers to the endothermic peak which is obtained by measuring the individually peeled photosensitive layer which has been thermally developed, employing a differential scanning calorimeter (DSC), such as EXSTAR 6000 (manufactured by Seiko Denshi Co.), DSC220C (manufactured by Seiko Denshi Kogyo Co.), and DSC-7 (manufactured by Perkin-Elmer Co.). Commonly, polymers exhibit a glass transition point, Tg. In silver salt photothermographic dry imaging materials, a large endothermic peak appears at a temperature lower than the Tg value of the binder resin employed in the photosensitive layer. The inventors of the present invention conducted diligent investigations while paying special attention to the thermal transition point temperature. As a result, it was discovered that by regulating the thermal transition point temperature to the range of 46 to 200° C., durability of the resultant coating layer increased and in addition, photographic characteristics such as speed, maximum density and image retention properties were markedly improved. Based on the discovery, the present invention was achieved.

The glass transition temperature (Tg) is determined employing the method, described in Brandlap, et al., "Polymer Handbook", pages from III-139 through III-179, 1966 (published by Wiley and Son Co.). The Tg of the binder composed of copolymer resins is obtained based on the following formula.

$$Tg \text{ of the copolymer (in } ^\circ \text{ C.)} = v_1 Tg_1 + v_2 Tg_2 + \ldots + v_n Tg_n$$

wherein $v_1$, $v_2$, . . . $v_n$ each represents the mass ratio of the monomer in the copolymer, and $Tg_1$, $Tg_2$, . . . $Tg_n$ each represents Tg (in ° C.) of the homopolymer which is prepared employing each monomer in the copolymer. The accuracy of Tg, calculated based on the formula calculation, is ±5° C.

In the silver salt photothermographic dry imaging material of the present invention, employed as binders, which are incorporated in the photosensitive layer, on the support, comprising aliphatic carboxylic acid silver salts, photosensitive silver halide grains and reducing agents, may be conventional polymers known in the art. The polymers have a Tg of 70 to 105° C., a number average molecular weight of 1,000 to 1,000,000, preferably from 10,000 to 500,000, and a degree of polymerization of about 50 to about 1,000. Examples of such polymers include polymers or copolymers composed of constituent units of ethylenic unsaturated monomers such as vinyl chloride, vinyl acetate, vinyl alcohol, maleic acid, acrylic acid, acrylic acid esters, vinylidene chloride, acrylonitrile, methacrylic acid, methacrylic acid esters, styrene, butadiene, ethylene, vinyl butyral, and vinyl acetal, as well as vinyl ether, and polyurethane resins and various types of rubber based resins.

Further listed are phenol resins, epoxy resins, polyurethane hardening type resins, urea resins, melamine resins, alkyd resins, formaldehyde resins, silicone resins, epoxy-polyamide resins, and polyester resins. Such resins are detailed in "Plastics Handbook", published by Asakura Shoten. These polymers are not particularly limited, and may be either homopolymers or copolymers as long as the resultant glass transition temperature, Tg is in the range of 70 to 105° C.

Listed as homopolymers or copolymers which comprise the ethylenic unsaturated monomers as constitution units are alkyl acrylates, aryl acrylates, alkyl methacrylates, aryl methacrylates, alkyl cyano acrylate, and aryl cyano acrylates, in which the alkyl group or aryl group may not be substituted. Specific alkyl groups and aryl groups include a methyl group, an ethyl group, an n-propyl group, an isopropyl group, an n-butyl group, an isobutyl group, a sec-butyl group, a tert-butyl group, an amyl group, a hexyl group, a cyclohexyl group, a benzyl group, a chlorophenyl group, an octyl group, a stearyl group, a sulfopropyl group, an N-ethyl-phenylaminoethyl group, a 2-(3-phenylpropyloxy) ethyl group, a dimethylaminophenoxyethyl group, a furfuryl group, a tetrahydrofurfuryl group, a phenyl group, a cresyl group, a naphthyl group, a 2-hydroxyethyl group, a 4-hydroxybutyl group, a triethylene glycol group, a dipropylene glycol group, a 2-methoxyethyl group, a 3-methoxybutyl group, a 2-actoxyethyl group, a 2-acetacttoxyethyl group, a 2-methoxyethyl group, a 2-iso-proxyethyl group, a 2-butoxyethyl group, a 2-(2-methoxyethoxy)ethyl group, a 2-(2-ethoxyetjoxy)ethyl group, a 2-(2-bitoxyethoxy)ethyl group, a 2-diphenylphsophorylethyl group, an □-methoxypolyethylene glycol (the number of addition mol n=6), an ally group, and dimethylaminoethylmethyl chloride.

In addition, employed may be the monomers described below. Vinyl esters: specific examples include vinyl acetate, vinyl propionate, vinyl butyrate, vinyl isobutyrate, vinyl corporate, vinyl chloroacetate, vinyl methoxyacetate, vinyl phenyl acetate, vinyl benzoate, and vinyl salicylate; N-substituted acrylamides, N-substituted methacrylamides and acrylamide and methacrylamide: N-substituents include a methyl group, an ethyl group, a propyl group, a butyl group, a tert-butyl group, a cyclohexyl group, a benzyl group, a hydroxymethyl group, a methoxyethyl group, a dimethylaminoethyl group, a phenyl group, a dimethyl group, a diethyl group, a β-cyanoethyl group, an N-(2-acetacetoxyethyl) group, a diacetone group; olefins: for example, dicyclopentadiene, ethylene, propylene, 1-butene, 1-pentane, vinyl chloride, vinylidene chloride, isoprene, chloroprene, butadiene, and 2,3-dimethylbutadiene; styrenes; for example, methylstyrene, dimethylstyrene, trimethylstyrene, ethylstyrene, isopropylstyrene, tert-butylstyrene, chloromethylstryene, methoxystyrene, acetoxystyrene, chlorostyrene, dichlorostyrene, bromostyrene, and vinyl methyl benzoate; vinyl ethers: for example, methyl vinyl ether, butyl vinyl ether, hexyl vinyl ether, methoxyethyl vinyl ether, and dimethylaminoethyl vinyl ether; N-substituted maleimides: N-substituents include a methyl group, an ethyl group, a propyl group, a butyl group, a tert-butyl group, a cyclohexyl group, a benzyl group, an n-dodecyl group, a phenyl group, a 2-methylphenyl group, a 2,6-diethylphenyl group, and a 2-chlorophenyl group; others include butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyl oxazolidone, N-vinyl pyrrolidone, acrylonitrile, metaacrylonitrile, methylene malonnitrile, vinylidene chloride.

Of these, listed as preferable examples are alkyl methacrylates, aryl methacrylates, and styrenes. Of such polymers, those having an acetal group are preferably employed because they exhibit excellent compatibility with the resultant aliphatic carboxylic acid, whereby an increase in flexibility of the resultant layer is effectively minimized.

Particularly preferred as polymers having an acetal group are the compounds represented by General Formula (V) described below.

General Formula (V)

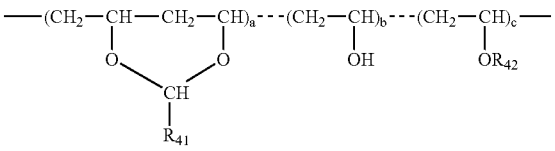

wherein $R_{41}$ represents a substituted or unsubstituted alkyl group, and a substituted or unsubstituted aryl group, however, groups other than the aryl group are preferred; $R_{42}$ represents a substituted or unsubstituted alkyl group, a substituted or unsubstituted aryl group, —$COR_{43}$ or —$CONHR_{43}$, wherein $R_{43}$ represents the same as defined above for $R_{41}$.

Employed as polyurethane resins usable in the present invention may be those, known in the art, having a structure of polyester polyurethane, polyether polyurethane, polyether polyester polyurethane, polycarbonate polyurethane, polyester polycarbonate polyurethane, or polycaprolactone polyurethane. It is preferable that, if desired, all polyurethanes described herein are substituted, through copolymerization or addition reaction, with at least one polar group selected from the group consisting of —$COOM_4$, —$SO_3M_4$, —$OSO_3M_4$, —P═O$(OM_4)_2$, —O—P═O$(OM_4)_2$ (wherein $M_4$ represents a hydrogen atom or an alkali metal salt group), —$N(R_{44})_2$, —$N^+(R_{44})_3$ (wherein $R_{44}$ represents a hydrocarbon group, and a plurality of $R_{44}$ may be the same or different), an epoxy group, —SH, and —CN. The amount of such polar groups is commonly from $10^{-1}$ to $10^{-8}$ mol/g, and is preferably from $10^{-2}$ to $10^{-6}$ mol/g. Other than the polar groups, it is preferable that the molecular terminal of the polyurethane molecule has at least one OH group and at least two OH groups in total. The OH group cross-links with polyisocyanate as a hardening agent so as to form a 3-dimensinal net structure. Therefore, the more OH groups which are incorporated in the molecule, the more preferred. It is particularly preferable that the OH group is positioned at the terminal of the molecule since thereby the reactivity with the hardening agent is enhanced. The polyurethane preferably has at least three OH groups at the terminal of the molecules, and more preferably has at least four OH groups. When polyurethane is employed, the polyurethane preferably has a glass transition temperature of 70 to 105° C., a breakage elongation of 100 to 2,000 percent, and a breakage stress of 0.5 to 100 N/mm$^2$.

These polymers may be employed individually or in combinations of at least two types as a binder. The polymers are employed as a main binder in the photosensitive silver salt containing layer (preferably in a photosensitive layer) of the present invention. The main binder, as described herein, refers to the binder in "the state in which the proportion of the aforesaid binder is at least 50 percent by weight of the total binders of the photosensitive silver salt containing layer". Accordingly, other binders may be employed in the range of less than 50 weight percent of the total binders. The other polymers are not particularly limited as long as they are soluble in the solvents capable of dissolving the polymers of the present invention. More preferably listed as the polymers are poly(vinyl acetate), acrylic resins, and urethane resins.

Compositions of polymers, which are preferably employed in the present invention, are shown in Table 1. Incidentally, Tg in Table 1 is a value determined employing a differential scanning calorimeter (DSC), manufactured by Seiko Denshi Kogyo Co., Ltd.

TABLE 1

| Polymer Name | Acetoacetal mol % | Butyral mol % | Acetal mol % | Acetyl mol % | Hydroxyl Group mol % | Tg Value (° C.) |
|---|---|---|---|---|---|---|
| P-1 | 6 | 4 | 73.7 | 1.7 | 24.6 | 85 |
| P-2 | 3 | 7 | 75.0 | 1.6 | 23.4 | 75 |
| P-3 | 10 | 0 | 73.6 | 1.9 | 24.5 | 110 |
| P-4 | 7 | 3 | 71.1 | 1.6 | 27.3 | 88 |
| P-5 | 10 | 0 | 73.3 | 1.9 | 24.8 | 104 |
| P-6 | 10 | 0 | 73.5 | 1.9 | 24.6 | 104 |
| P-7 | 3 | 7 | 74.4 | 1.6 | 24.0 | 75 |
| P-8 | 3 | 7 | 75.4 | 1.6 | 23.0 | 74 |
| P-9 | — | — | — | — | — | 60 |

Incidentally, in Table 1, P-9 is a polyvinyl butyral resin B-79, manufactured by Solutia Ltd.

In the present invention, it is known that by employing cross-linking agents in the aforesaid binders, uneven development is minimized due to the improved adhesion of the layer to the support. In addition, it results in such effects that fogging during storage is minimized and the creation of printout silver after development is also minimized.

Employed as cross-linking agents used in the present invention may be various conventional cross-linking agents, which have been employed for silver halide photosensitive photographic materials, such as aldehyde based, epoxy based, ethyleneimine based, vinylsulfone based sulfonic acid ester based, acryloyl based, carbodiimide based, and silane compound based cross-linking agents, which are described in Japanese Patent O.P.I. Publication No. 50-96216. Of these, preferred are isocyanate based compounds, silane compounds, epoxy compounds or acid anhydrides, as shown below.

As one of preferred cross-linking agents, isocyanate based and thioisocyanate based cross-linking agents represented by General Formula (IC), shown below, will now be described.

$$X_{21}{=}C{=}N\text{-}L_{v21}\text{-}(N{=}C{=}X_{21})$$ General Formula (IC)

wherein v21 represents 1 or 2; $L_{21}$ represents an alkyl group, an aryl group, or an alkylaryl group which is a linking group having a valence of v+1; and $X_{21}$ represents an oxygen atom or a sulfur atom.

Incidentally, in the compounds represented by aforesaid General Formula (IC), the aryl ring of the aryl group may have a substituent. Preferred substituents are selected from the group consisting of a halogen atom (for example, a bromine atom or a chlorine atom), a hydroxyl group, an amino group, a carboxyl group, an alkyl group and an alkoxy group.

The aforesaid isocyanate based cross-linking agents are isocyanates having at least two isocyanate groups and adducts thereof. More specifically, listed are aliphatic isocyanates, aliphatic isocyanates having a ring group, benzene diisocyanates, naphthalene diisocyanates, biphenyl isocyanates, diphenylmethane diisocyanates, triphenylmethane diisocyanates, triisocyanates, tetraisocyanates, and adducts of these isocyanates and adducts of these isocyanates with dihydric or trihydric polyalcohols.

Employed as specific examples may be isocyanate compounds described on pages 10 through 12 of Japanese Patent O.P.I. Publication No. 56-5535.

Incidentally, adducts of isocyanates with polyalcohols are capable of markedly improving the adhesion between layers and further of markedly minimizing layer peeling, image dislocation, and air bubble formation. Such isocyanates may be incorporated in any portion of the silver salt photothermographic dry imaging material. They may be incorporated in, for example, a support (particularly, when the support is paper, they may be incorporated in a sizing composition), and optional layers such as a photosensitive layer, a surface protective layer, an interlayer, an antihalation layer, and a subbing layer, all of which are placed on the photosensitive layer side of the support, and may be incorporated in at least two of the layers.

Further, as thioisocyanate based cross-linking agents usable in the present invention, compounds having a thioisocyanate structure corresponding to the isocyanates are also useful.

The amount of the cross-linking agents employed in the present invention is in the range of 0.001 to 2.000 mol per mol of silver, and is preferably in the range of 0.005 to 0.500 mol.

Isocyanate compounds as well as thioisocyanate compounds, which may be incorporated in the present invention, are preferably those which function as the cross-linking agent. However, it is possible to obtain the desired results by employing compounds which have a v21 of 0, namely compounds having only one functional group.

Listed as examples of silane compounds which can be employed as a cross-linking agent in the present invention are compounds represented by General Formal (1) or General Formula (2), described in Japanese Patent O.P.I. Publication No. 2002-22203.

Compounds, which can be used as a cross-linking agent, may be those having at least one epoxy group. The number of epoxy groups and corresponding molecular weight are not limited. It is preferable that the epoxy group be incorporated in the molecule as a glycidyl group via an ether bond or an imino bond. Further, the epoxy compound may be a monomer, an oligomer, or a polymer. The number of epoxy groups in the molecule is commonly from about 1 to about 10, and is preferably from 2 to 4. When the epoxy compound is a polymer, it may be either a homopolymer or a copolymer, and its number average molecular weight Mn is most preferably in the range of about 2,000 to about 20,000.

Preferred as epoxy compounds are those represented by General Formula (EP) described below.

General Formula (EP)

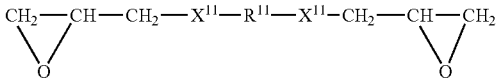

In General Formula (EP), the linking group represented by $R^{11}$ preferably has an amido linking portion, an ether linking portion, or a thioether linking portion. The divalent linking group, represented by $X^{11}$, is preferably —$SO_2$—, —$SO_2NH$—, —S—, —O—, or —$NR^{12}$—, wherein $R^{12}$ represents a univalent group, which is preferably an electron attractive group.

These epoxy compounds may be employed individually or in combinations of at least two types. The added amount is not particularly limited but is preferably in the range of $1\times10^{-6}$ to $1\times10^{-2}$ mol/$m^2$, and is more preferably in the range of $1\times10^{-5}$ to $1\times10^{-3}$ mol/$m^2$.

The epoxy compounds may be incorporated in optional layers on the photosensitive layer side of a support, such as a photosensitive layer, a surface protective layer, an interlayer, an antihalation layer, and a subbing layer, and may be incorporated in at least two layers. In addition, the epoxy compounds may be incorporated in optional layers on the side opposite the photosensitive layer on the support. Incidentally, when a photosensitive material has a photosensitive layer on both sides, the epoxy compounds may be incorporated in any layer.

Acid anhydrides are compounds which have at least one acid anhydride group having the structural formula described below.

—CO—O—CO—

The acid anhydrites are to have at least one such acid anhydride group. The number of acid anhydride groups, and the molecular weight are not limited, but the compounds represented by General Formula (SA) are preferred.

General Formula (SA)

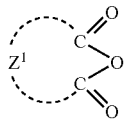

In General Formula (SA), $Z^1$ represents a group of atoms necessary for forming a single ring or a polycyclic system. These cyclic systems may be unsubstituted or substituted. Example of substituents include an alkyl group (for example, a methyl group, an ethyl group, or a hexyl group), an alkoxy group (for example, a methoxy group, an ethoxy group, or an octyloxy group), an aryl group (for example, a phenyl group, a naphthyl group, or a tolyl group), a hydroxyl group, an aryloxy group (for example, a phenoxy group), an alkylthio group (for example, a methylthio group or a butylthio group), an arylthio group (for example, a phenylthio group), an acyl group (for example, an acetyl group, a propionyl group, or a butyryl group), a sulfonyl group (for example, a methylsulfonyl group, or a phenylsulfonyl group), an acylamino group, a sulfonylamino group, an acyloxy group (for example, an acetoxy group or a benzoxy group), a carboxyl group, a cyano group, a sulfo group, and an amino group. Substituents are preferably those which do not contain a halogen atom.

These acid anhydrides may be employed individually or in combinations of at least two types. The added amount is not particularly limited, but is preferably in the range of $1\times10^{-6}$ to $1\times10^{-2}$ mol/$m^2$ and is more preferably in the range of $1\times10^{-5}$ to $1\times10^{-3}$ mol/$m^2$.

In the present invention, the acid anhydrides may be incorporated in optional layers on the photosensitive layer side on a support, such as a photosensitive layer, a surface protective layer, an interlayer, an antihalation layer, or a subbing layer, and may be incorporated in at least two layers. Further, the acid anhydrides may be incorporated in the layer(s) in which the epoxy compounds are incorporated.

<Tone Controlling Agent>

The tone of images obtained by thermal development of the imaging material is described.

It has been pointed out that in regard to the output image tone for medical diagnosis, cold image tone tends to result in more accurate diagnostic observation of radiographs. The cold image tone, as described herein, refers to pure black tone or blue black tone in which black images are tinted to blue. On the other hand, warm image tone refers to warm black tone in which black images are tinted to brown.

The tone is more described below based on an expression defined by a method recommended by the Commission Internationale de l'Eclairage (CIE) in order to define more quantitatively.

"Colder tone" as well as "warmer tone", which is terminology of image tone, is expressed, employing minimum density $D_{min}$ and hue angle $h_{ab}$ at an optical density D of 1.0. The hue angle $h_{ab}$ is obtained by the following formula, utilizing color specifications a* and b* of L*a*b* Color Space which is a color space perceptively having approximately a uniform rate, recommended by Commission Internationale de l'Eclairage (CIE) in 1976.

$$h_{ab}=\tan^{-1}(b^*/a^*)$$

In the present invention, $h_{ab}$ is preferably in the range of 180 degrees<$h_{ab}$<270 degrees, is more preferably in the range of 200 degrees<$h_{ab}$<270 degrees, and is most preferably in the range of 220 degrees<$h_{ab}$<260 degrees. This finding is also disclosed in Japanese Patent O.P.I. Publication No. 2002-6463.

Incidentally, as described, for example, in Japanese Patent O.P.I. Publication No. 2000-29164, it is conventionally known that diagnostic images with visually preferred color tone are obtained by adjusting, to the specified values, u* and v* or a* and b* in CIE 1976 (L*u*v*) color space or (L*a*b*) color space near an optical density of 1.0.

Diligent investigation was performed for the photothermographic imaging material according to the present invention. As a result, it was discovered that when a linear regression line was formed on a graph in which in the CIE 1976 (L*u*v*) color space or the (L*a*b*) color space, u* or a* was used as the abscissa and v* or b* was used as the ordinate, the aforesaid materiel exhibited diagnostic properties which were equal to or better than conventional wet type silver salt photosensitive materials by regulating the resulting linear regression line to the specified range. The condition ranges of the present invention will now be described.

1) The coefficient of determination value $R^2$ of the linear regression line is 0.998–1.000, which is formed in such a manner that each of optical density of 0.5, 1.0, and 1.5 and the minimum optical density of the aforesaid imaging material is measured, and u* and v* in terms of each of the above optical densities are arranged in two-dimensional coordinates in which u* is used as the abscissa of the CIE 1976 (L*u*v*) color space, while v* is used as the ordinate of the same.

In addition, value v* of the intersection point of the aforesaid linear regression line with the ordinate is from −5 to +5, while gradient (v*/u*) is from 0.7 to 2.5.

2) The coefficient of determination value $R^2$ of the linear regression line is 0.998–1.000, which is formed in such a manner that each of optical density of 0.5, 1.0, and 1.5 and the minimum optical density of the aforesaid imaging material is measured, and a* and b* in terms of each of the above optical densities are arranged in two-dimensional coordinates in which a* is used as the abscissa of the CIE 1976 (L*a*b*) color space, while b* is used as the ordinate of the same.

In addition, value b* of the intersection point of the aforesaid linear regression line with the ordinate is from −5 to +5, while gradient (b*/a*) is from 0.7 to 2.5.

A method for making the above-mentioned linear regression line, namely one example of a method for determining u* and v* as well as a* and b* in the CIE 1976 color space, will now be described.

By employing a thermal development apparatus, a 4-step wedge sample including an unexposed portion and optical densities of 0.5, 1.0, and 1.5 is prepared. Each of the wedge density portions prepared as above is determined employing a spectral chronometer (for example, CM-3600d, manufactured by Minolta Co., Ltd.) and either u* and v* or a* and b* are calculated. Measurement conditions are such that an F7 light source is used as a light source, the visual field angle is 10 degrees, and the transmission measurement mode is used. Subsequently, either measured u* and v* or measured a* and b* are plotted on the graph in which u* or a* is used as the abscissa, while v* or b* is used as the ordinate, and a linear regression line is formed, whereby the coefficient of determination value $R^2$ as well as intersection points and gradients are determined.

The specific method enabling to obtain a linear regression line having the above-described characteristics will be described below.

In the present invention, by regulating the added amount of the aforesaid toning agents, developing agents, silver halide grains, and aliphatic carboxylic acid silver, which are directly or indirectly involved in the development reaction process, it is possible to optimize the shape of developed silver so as to result in the desired tone. For example, when the developed silver is shaped to dendrite, the resulting image tends to be bluish, while when shaped to filament, the resulting imager tends to be yellowish. Namely, it is possible to adjust the image tone taking into account the properties of shape of developed silver.

Usually, toning agents such as phthalazinones or a combinations of phthalazine with phthalic acids, or phthalic anhydride are employed. Examples of suitable image toning agents are disclosed in Research Disclosure, Item 17029, and U.S. Pat. Nos. 4,123,282, 3,994,732, 3,846,136, and 4,021,249.

Other than such toners, it is preferable to control color tone employing couplers disclosed in Japanese Patent O.P.I. Publication No. 11-288057 and EP 1134611A2 as well as leuco dyes detailed below.

Further, it is possible to unexpectedly minimize variation of tone during storage of silver images by simultaneously employing silver halide grains which are converted into an internal latent image-forming type after the thermal development according to the present, invention.

<Leuco Dyes>

Leuco dyes are employed in the silver salt photothermographic dry imaging materials of the present invention.

Employed as leuco dyes may be any of the colorless or slightly tinted compounds which are oxidized to form a colored state when heated at temperatures of about 80–about 200° C. for about 0.5–about 30 seconds. It is possible to use any of the leuco dyes which are oxidized by silver ions to form dyes. Compounds are useful which are sensitive to pH and oxidizable to a colored state.

Representative leuco dyes suitable for the use in the present invention are not particularly limited. Examples include biphenol leuco dyes, phenol leuco dyes, indoaniline leuco dyes, acrylated azine leuco dyes, phenoxazine leuco dyes, phenodiazine leuco dyes, and phenothiazine leuco dyes. Further, other useful leuco dyes are those disclosed in U.S. Pat. Nos. 3,445,234, 3,846,136, 3,994,732, 4,021,249, 4,021,250, 4,022,617, 4,123,282, 4,368,247, and 4,461,681, as well as Japanese Patent O.P.I. Publication Nos. 50-36110, 59-206831, 5-204087, 11-231460, 2002-169249, and 2002-236334.

In order to control images to specified color tones, it is preferable that various color leuco dyes are employed individually or in combinations of a plurality of types. In the present invention, for minimizing excessive yellowish color tone due to the use of highly active reducing agents, as well as excessive reddish images especially at a density of at least 2.0 due to the use of minute silver halide grains, it is preferable to employ leuco dyes which change to cyan. Further, in order to achieve precise adjustment of color tone, it is further preferable to simultaneously use yellow leuco dyes as well as other leuco dyes which change to cyan.

It is preferable to appropriately control the density of the resulting color while taking into account the relationship with the color tone of developed silver itself. In the present invention, color formation is performed so that the sum of maximum densities at the maximum adsorption wavelengths of dye images formed by leuco dyes is customarily 0.01–0.30, is preferably 0.02–0.20, and is most preferably 0.02–0.10. Further, it is preferable that images be controlled within the preferred color tone range described below.

(Yellow Forming Leuco Dyes)

In the present invention, particularly preferably employed as yellow forming leuco dyes are color image forming agents which increase absorbance between 360 and 450 nm via oxidation. Most preferably employed is a color image forming agent which is represented by following General Formula (YL).

General Formula (YL)

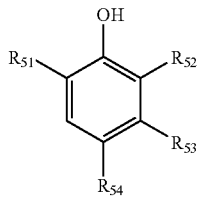

$R_{51}$ represents an alkyl group, and $R_{52}$ represents a hydrogen atom, a substituted or unsubstituted alkyl group, or an acylamino group. $R_{53}$ represents a hydrogen atom, and a substituted or unsubstituted alkyl group, and $R_{54}$ represents a group capable of being substituted toga benzene ring.

Among the compounds represented by General Formula (YL), preferred compounds are those represented by the following General Formula (YL').

General Formula (YL')

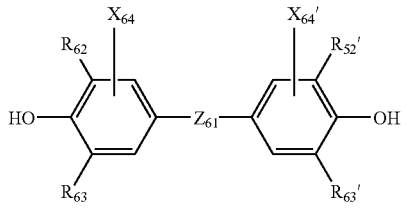

wherein, $Z_{61}$ represents a —S— or —C($R_{61}$)($R_{61}$')— group. $R_{61}$ and $R_{61}$' each represent a hydrogen atom or a substituent. $R_{62}$, $R_{63}$, $R_{62}$', and $R_{63}$' each represent a substituent.

Examples of the bis-phenol compounds represented by General Formula (YL) are, the compounds disclosed in JP-A No. 2002-169249, Compounds (II-1) to (II-40), paragraph Nos. [0032]–[0038]; and EP 1211093, Compounds (ITS-1) to (ITS-12), paragraph No. [0026]. Specific examples of the compounds represented by General Formula (YL) include YL-1 to 15 described in paragraph Nos. [0396]–[0397] of Japanese Patent Application No. 2003-320555

An amount of an incorporated compound represented by General Formula (YL) is; usually, 0.00001 to 0.01 mol, and preferably, 0.0005 to 0.01 mol, and more preferably, 0.001 to 0.008 mol per mol of Ag.

(Cyan Forming Leuco Dyes)

Cyan forming leuco dyes will now be described. In the present invention, particularly preferably employed as cyan forming leuco dyes are color image forming agents which increase absorbance between 600 and 700 nm via oxidation, and. include the compounds described in Japanese Patent O.P.I. Publication No. 59-206831 (particularly, compounds of λmax in the range of 600–700 nm), compounds represented by General Formulas (I)–(IV) of Japanese Patent O.P.I. Publication No. 5-204087 (specifically, compounds (1)–(18) described in paragraphs [0032]–[0037]), and compounds represented by General Formulas 4–7 (specifically, compound Nos. 1–79 described in paragraph [0105]) of Japanese Patent O.P.I. Publication No. 11-231460.

Cyan forming leuco dyes which are particularly preferably employed in the present invention are represented by following General Formula (CL).

General Formula (CL)

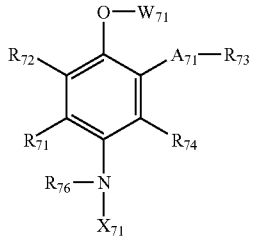

wherein $R_{71}$ and $R_{72}$ each represent a hydrogen atom, a substituted or unsubstituted alkyl group, an NHCO—$R_{79}$ group wherein $R_{79}$ is an alkyl group, an aryl group, or a heterocyclic group, while $R_{71}$ and $R_{72}$ may bond to each other to form an aliphatic hydrocarbon ring, an aromatic hydrocarbon ring, or a heterocyclic ring; $A_{71}$ represents a —NHCO— group, a —CONH— group, or a —NH-CONH— group; $R_{73}$ represents a substituted or unsubstituted alkyl group, an aryl group, or a heterocyclic group, or -$A_{71}$-$R_{73}$ is a hydrogen atom; $W_{71}$ represents a hydrogen atom or a —CONH$R_{75}$— group, —CO$R_{75}$ or a —CO—O—$R_{75}$ group wherein $R_{75}$ represents a substituted or unsubstituted alkyl group, an aryl group, or a heterocyclic group; $R_{74}$ represents a hydrogen atom, a halogen atom, a substituted or unsubstituted alkyl group, an alkoxy group, a carbamoyl group, or a nitrile group; $R_{76}$ represents a —CONH—$R_{77}$ group, a —CO—$R_{77}$ group, or a —CO—O—$R_{77}$ group wherein $R_{77}$ is a substituted or unsubstituted alkyl group, an aryl group, or a heterocyclic group; and $X_{71}$ represents a substituted or unsubstituted aryl group or a heterocyclic group.

Specific examples of cyan forming leuco dyes (CL) include CL-1 to 12 described in paragraph Nos. [0405]–

[0407] of Japanese Patent Application No. 2003-320555 (Japanese Patent O.P.I. Publication 2005-107496).

The added amount of cyan forming leuco dyes is customarily 0.00001–0.05 mol/mol of Ag, is preferably 0.0005–0.02 mol/mol of Ag, and is more preferably 0.001–0.01 mol/mol of Ag.

The compounds represented by General Formula (YL) and cyan forming leuco dyes may be added employing the same method as for the reducing agents represented by General Formula (RED). They may be incorporated in liquid coating compositions employing an optional method to result in a solution form, an emulsified dispersion form, or a minute solid particle dispersion form, and then incorporated in a photosensitive material.

It is preferable to incorporate the compounds represented by General Formula (YL) and cyan forming leuco dyes into an image forming layer containing organic silver salts. On the other hand, the former may be incorporated in the image forming layer, while the latter may be incorporated in a non-image forming layer adjacent to the aforesaid image forming layer. Alternatively, both may be incorporated in the non-image forming layer. Further, when the image forming layer is composed of a plurality of layers, incorporation may be performed for each of the layers.

<Coating Auxiliaries and Others>

In the present invention, in order to minimize image abrasion caused by handling prior to development as well as after thermal development, matting agents are preferably incorporated in the surface layer (on the photosensitive layer side, and also on the other side when the light-insensitive layer is provided on the opposite side across the support). The added amount is preferably from 0.1 to 30.0 percent by weight with respect to the binders.

Matting agents may be composed of organic or inorganic materials. Employed as inorganic materials for the matting agents may be, for example, silica described in Swiss Patent No. 330,158, glass powder described in French Patent No. 1,296,995, and carbonates of alkali earth metals or cadmium and zinc described in British Patent No. 1,173,181. Employed as organic materials for the matting agents are starch described in U.S. Pat. No. 2,322,037, starch derivatives described in Belgian Patent No. 625,451 and British Patent No. 981,198, polyvinyl alcohol described in Japanese Patent Publication No. 44-3643, polystyrene or polymethacrylate described in Swiss Patent No. 330,158, acrylonitrile described in U.S. Pat. No. 3,079,257, and polycarbonate described in U.S. Pat. No. 3,022,169.

The average particle diameter of the matting agents is preferably from 0.5 to 10.0 μm, and is more preferably from 1.0 to 8.0 μm. Further, the variation coefficient of the particle size distribution of the same is preferably not more than 50 percent, is more preferably not more than 40 percent, and is most preferably from not more than 30 percent.

Herein, the variation coefficient of the particle size distribution refers to the value expressed by the formula described below.

((Standard deviation of particle diameter)/(particle diameter average))×100

Addition methods of the matting agent according to the present invention may include one in which the matting agent is previously dispersed in a coating composition and the resultant dispersion is applied onto a support, and the other in which after applying a coating composition onto a support, a matting agent is sprayed onto the resultant coating prior to completion of drying. Further, when a plurality of matting agents is employed, both methods may be used in combination.

<Fluorine Based Surface Active Agents>

It is preferable to employ the fluorine based surface active agents represented by following General Formulas (SA-1)–(SA-3) in the imaging materials according to the present invention.

$$(Rf\text{-}L_{81})_{p81}\text{-}Y_{81}\text{-}(A_{81})_{q81} \qquad \text{General Formula (SA-1)}$$

$$LiO_3S\text{—}(CF_2)_{n81}\text{—}SO_3Li \qquad \text{General Formula (SA-2)}$$

$$M_{81}O_3S\text{—}(CF_2)_n\text{—}SO_3M_{81} \qquad \text{General Formula (SA-3)}$$

wherein $M_{81}$ represents a hydrogen atom, a sodium atom, a potassium atom, and an ammonium group; n represents a positive integer, while in the case in which $M_{81}$ represents H, n81 represents an integer of 1–6 and 8, and in the case in which $M_{81}$ represents an ammonium group, n represents an integer of 1–8.

In aforesaid General Formula (SA-1), Rf represents a substituent containing a fluorine atom. Listed as fluorine atom-containing substituents are, for example, an alkyl group having 1–25 carbon atoms (such as a methyl group, an ethyl group, a butyl group, an octyl group, a dodecyl group, or an octadecyl group), and an alkenyl group (such as a propenyl group, a butenyl group, a nonenyl group or a dodecenyl group).

$L_{81}$ represents a divalent linking group having no fluorine atom. Listed as divalent linking groups having no fluorine atom are, for example, an alkylene group (e.g., a methylene group, an ethylene group, and a butylene group), an alkyleneoxy group (such as a methyleneoxy group, an ethyleneoxy group, or a butyleneoxy group), an oxyalkylene group (e.g., an oxymethylene group, an oxyethylene group, and an oxybutylene group), an oxyalkyleneoxy group (e.g., an oxymethyleneoxy group, an oxyethyleneoxy group, and an oxyethyleneoxyethyleneoxy group), a phenylene group, and an oxyphenylene group, a phenyloxy group, and an oxyphenyloxy group, or a group formed by combining these groups.

$A_{81}$ represents an anion group or a salt group thereof. Examples include a carboxylic acid group or salt groups thereof (sodium salts, potassium salts and lithium salts), a sulfonic acid group or salt groups thereof (sodium salts, potassium salts and lithium salts), and a phosphoric acid group and salt groups thereof (sodium salts, potassium salts and lithium salts).

$Y_{81}$ represents a trivalent or tetravalent linking group having no fluorine atom. Examples include trivalent or tetravalent linking groups having no fluorine atom, which are groups of atoms composed of a nitrogen atom as the center. P81 represents an integer from 1 to 3, while $q_{81}$ represents an integer of 2 or 3.

The fluorine based surface active agents represented by General Formula (SA-1) are prepared as follows. Alkyl compounds having 1–25 carbon atoms into which fluorine atoms are introduced (e.g., compounds having a trifluoromethyl group, a pentafluoroethyl group, a perfluorobutyl group, a perfluorooctyl group, or a perfluorooctadecyl group) and alkenyl compounds (e.g., a perfluorohexenyl group or a perfluorononenyl group) undergo addition reaction or condensation reaction with each of the trivalent-hexavalent alknaol compounds into which fluorine atom(s) are not introduced, aromatic compounds having 3–4 hydroxyl groups or hetero compounds. Anion group ($A_{81}$) is further introduced into the resulting compounds (including alknaol compounds which have been partially subjected to introduction of Rf) employing, for example, sulfuric acid esterification.

Listed as the aforesaid trivalent-hexavalent alkanol compounds are glycerin, pentaerythritol, 2-methyl-2-hydroxymethyl-1,3-propanediol, 2,4-dihydroxy-3-hydroxymethylpentane, 1,2,6-hexanrtriol, 1,1,1-tris(hydroxymethyl)propane, 2,2-bis(butanol), aliphatic triol, tetramethylolmethane, D-sorbitol, xylitol, and D-mannitol.

Listed as the aforesaid aromatic compounds, having 3–4 hydroxyl groups and hetero compounds, are 1,3,5-trihydroxybenzene and 2,4,6-trihydroxypyridine.

It is possible to add the fluorine based surface active agents represented by General Formulas (SA-1)–(SA-3) to liquid coating compositions, employing any conventional addition methods known in the art. Namely, they are dissolved in solvents such as alcohols including methanol or ethanol, ketones such as methyl ethyl ketone or acetone, and polar solvents such as dimethylformamide, and then added. Further, they may be dispersed into water or organic solvents in the form of minute particles at a maximum size of 1 μm, employing a sand mill, a jet mill, or an ultrasonic homogenizer and then added. Many techniques are disclosed for minute particle dispersion, and it is possible to perform dispersion based on any of these. It is preferable that the aforesaid fluorine based surface active agents are added to the protective layer which is the outermost layer.

The added amount of the aforesaid fluorine based surface active agents is preferably $1\times10^{-8}$–$1\times10^{-1}$ mol per $m^2$. When the added amount is less than the lower limit, it is not possible to achieve desired charging characteristics, while it exceeds the upper limit, storage stability degrades due to an increase in humidity dependence.

Incidentally, surface active agents represented by General Formulas (SA-1), (SA-2), and (SA-3) are disclosed in Japanese Patent O.P.I. Publication No. 2003-57786, and Japanese Patent Application Nos. 2002-178386 and 2003-237982.

Listed as materials of the support employed in the silver salt photothermographic dry imaging material of the present invention are various kinds of polymers, glass, wool fabric, cotton fabric, paper, and metal (for example, aluminum). From the viewpoint of handling as information recording materials, flexible materials, which can be employed as a sheet or can be wound in a roll, are suitable. Accordingly, preferred as supports in the silver salt photothermographic dry imaging material of the present invention are plastic films (for example, cellulose acetate film, polyester film, polyethylene terephthalate film, polyethylene naphthalate film, polyamide film, polyimide film, cellulose triacetate film or polycarbonate film). Of these, in the present invention, biaxially stretched polyethylene terephthalate film is particularly preferred. The thickness of the supports is commonly from about 50 to about 300 μm, and is preferably from 70 to 180 μm.

In the present invention, in order to minimize static-charge buildup, electrically conductive compounds such as metal oxides and/or electrically conductive polymers may be incorporated in composition layers. The compounds may be incorporated in any layer, but are preferably incorporated in a subbing layer, a backing layer, and an interlayer between the photosensitive layer and the subbing layer. In the present invention, preferably employed are electrically conductive compounds described in columns 14 through 20 of U.S. Pat. No. 5,244,773.

The silver salt photothermographic dry imaging material of the present invention comprises a support having thereon at least one photosensitive layer. The photosensitive layer may only be formed on the support. However, it is preferable that at least one light-insensitive layer is formed on the photosensitive layer. For example, it is preferable that for the purpose of protecting a photosensitive layer, a protective layer is formed on the photosensitive layer, and in order to minimize adhesion between photosensitive materials as well as adhesion in a wound roll, a backing layer is provided on the opposite side of the support. As binders employed in the protective layer as well as the backing layer, polymers such as cellulose acetate, cellulose acetate butyrate, which has a higher glass transition point from the thermal development layer and exhibit abrasion resistance as well as distortion resistance are selected from the aforesaid binders. Incidentally, for the purpose of increasing latitude, one of the preferred embodiments of the present invention is that at least two photosensitive layers are provided on the one side of the support or at least one photosensitive layer is provided on both sides of the support.

In the silver salt photothermographic dry imaging material of the present invention, in order to control the light amount as well as the wavelength distribution of light which transmits the photosensitive layer, it is preferable that a filter layer is formed on the photosensitive layer side or on the opposite side, or dyes or pigments are incorporated in the photosensitive layer.

Employed as dyes may be compounds, known in the art, which absorb various wavelength regions according to the spectral sensitivity of photosensitive materials.

For example, when the silver salt photothermographic dry imaging material of the present invention is used as an image recording material utilizing infrared radiation, it is preferable to employ squarylium dyes having a thiopyrylium nucleus (hereinafter referred to as thiopyriliumsquarylium dyes) and squarylium dyes having a pyrylium nucleus (hereinafter referred to as pyryliumsquarylium dyes), as described in Japanese Patent Application No. 11-255557, and thiopyryliumcroconium dyes or pyryliumcroconium dyes which are analogous to the squarylium dyes.

Incidentally, the compounds having a squarylium nucleus, as described herein, refers to ones having 1-cyclobutene-2-hydroxy-4-one in their molecular structure. Herein, the hydroxyl group may be dissociated. Hereinafter, all of these dyes are referred to as squarylium dyes.

Incidentally, preferably employed as the dyes are compounds described in Japanese Patent O.P.I. Publication No. 8-201959.

<Layer Structures and Coating Conditions>

It is preferable to prepare the silver salt photothermographic dry imaging material of the present invention as follows. Materials of each constitution layer as above are dissolved or dispersed in solvents to prepare coating compositions. Resultant coating compositions are subjected to simultaneous multilayer coating and subsequently, the resultant coating is subjected to a thermal treatment. "Simultaneous multilayer coating", as described herein, refers to the following. The coating composition of each constitution layer (for example, a photosensitive layer and a protective layer) is prepared. When the resultant coating compositions are applied onto a support, the coating compositions are not applied onto a support in such a manner that they are individually applied and subsequently dried, and the operation is repeated, but are simultaneously applied onto a support and subsequently dried.

Simultaneous multilayer coating methods, which are applied to each constitution layer, are not particularly limited. For example, are employed methods, known in the art, such as a bar coater method, a curtain coating method, a dipping method, an air knife method, a hopper coating method, and an extrusion method. Of these, more preferred is the pre-weighing type coating system called an extrusion coating method. The aforesaid extrusion coating method is suitable for accurate coating as well as organic solvent coating because volatilization on a slide surface, which occurs in a slide coating system, does not occur. Coating methods have been described for coating layers on the photosensitive layer side. However, the backing layer and the subbing layer are applied onto a support in the same manner as above.

In the present invention, silver coverage is preferably from 0.5 to 2.0 g/m$^2$, and is more preferably from 1.0 to 1.5 g/m$^2$.

Further, in the present invention, it is preferable that in the silver halide grain emulsion, the content ratio of silver halide grains, having a grain diameter of 0.030 to 0.055 μm in term of the silver weight, is from 3 to 15 percent in the range of a silver coverage of 0.5 to 1.5 g/m$^2$.

The ratio of the silver coverage which is resulted from silver halide is preferably from 2 to 18 percent with respect to the total silver, and is more preferably from 3 to 15 percent.

Further, in the present invention, the number of coated silver halide grains, having a grain diameter (being a sphere equivalent grain diameter) of at least 0.01 μm, is preferably from $1\times10^{14}$ to $1\times10^{18}$ grains/m$^2$, and is more preferably from $1\times10^{15}$ to $1\times10^{17}$ grains/m$^2$.

Further, the coated weight of aliphatic carboxylic acid silver salts of the present invention is from $10^{-17}$ to $10^{-15}$ g per silver halide grain having a diameter (being a sphere equivalent grain diameter) of at least 0.01 μm, and is more preferably from $10^{-16}$ to $10^{-14}$ g.

When coating is carried out under conditions within the aforesaid range, from the viewpoint of maximum optical silver image density per definite silver coverage, namely covering power as well as silver image tone, desired results are obtained.

<Exposure Conditions>

When the silver salt photothermographic dry imaging material of the present invention is exposed, it is preferable to employ an optimal light source for the spectral sensitivity provided to the aforesaid photosensitive material. For example, when the aforesaid photosensitive material is sensitive to infrared radiation, it is possible to use any radiation source which emits radiation in the infrared region. However, infrared semiconductor lasers (at 780 nm and 820 nm) are preferably employed due to their high power, as well as ability to make photosensitive materials transparent.

In the present invention, it is preferable that exposure is carried out utilizing laser scanning. Employed as the exposure methods are various ones. For example, listed as a firstly preferable method is the method utilizing a laser scanning exposure apparatus in which the angle between the scanning surface of a photosensitive material and the scanning laser beam does not substantially become vertical.

"Does not substantially become vertical", as described herein, means that during laser scanning, the nearest vertical angle is preferably from 55 to 88 degrees, is more preferably from 60 to 86 degrees, and is most preferably from 70 to 82 degrees.

When the laser beam scans photosensitive materials, the beam spot diameter on the exposed surface of the photosensitive material is preferably at most 200 μm, and is more preferably at most 100 mm, and is more preferably at most 100 μm. It is preferable to decrease the spot diameter due to the fact that it is possible to decrease the deviated angle from the verticality of laser beam incident angle. Incidentally, the lower limit of the laser beam spot diameter is 10 μm. By performing the laser beam scanning exposure, it is possible to minimize degradation of image quality according to reflection light such as generation of unevenness analogous to interference fringes.

Further, as the second method, exposure in the present invention is also preferably carried out employing a laser scanning exposure apparatus which generates a scanning laser beam in a longitudinal multiple mode, which minimizes degradation of image quality such as generation of unevenness analogous to interference fringes, compared to the scanning laser beam in a longitudinal single mode.

The longitudinal multiple mode is achieved utilizing methods in which return light due to integrated wave is employed, or high frequency superposition is applied. The longitudinal multiple mode, as described herein, means that the wavelength of radiation employed for exposure is not single. The wavelength distribution of the radiation is commonly at least 5 nm, and is preferably at least 10 nm. The upper limit of the wavelength of the radiation is not particularly limited, but is commonly about 60 nm.

Incidentally, in the recording methods of the aforesaid first and second embodiments, it is possible to suitably select any of the following lasers employed for scanning exposure, which are generally well known, while matching the use. The aforesaid lasers include solid lasers such as a ruby laser, a YAG laser, and a glass laser; gas lasers such as a HeNe laser, an Ar ion laser, a Kr ion laser, a $CO_2$ laser a CO laser, a HeCd laser, an $N_2$ laser, and an excimer laser; semiconductor lasers such as an InGaP laser, an AlGaAs laser, a GaASP laser, an InGaAs laser, an InAsP laser, a $CdSnP_2$ laser, and a GaSb laser; chemical lasers; and dye lasers. Of these, from the viewpoint of maintenance as well as the size of light sources, it is preferable to employ any of the semiconductor lasers having a wavelength of 600 to 1,200 nm. The beam spot diameter of lasers employed in laser imagers, as well as laser image setters, is commonly in the range of 5 to 75 μm in terms of a short axis diameter and in the range of 5 to 100 μm in terms of a long axis diameter. Further, it is possible to set a laser beam scanning rate at the optimal value for each photosensitive material depending on the inherent speed of the silver salt photothermographic dry imaging material at laser transmitting wavelength and the laser power.

<Development Conditions>

In the present invention, development conditions vary depending on employed devices and apparatuses, or means. Typically, an imagewise exposed silver salt photothermographic dry imaging material is heated at optimal high temperature. It is possible to develop a latent image formed by exposure by heating the material at relatively high temperature (for example, from about 100 to about 200° C.) for a sufficient period (commonly from about 1 second to about 2 minutes). When heating temperature is not more than 100° C., it is difficult to obtain sufficient image density within a relatively short period. On the other hand, at not less than 200° C., binders melt so as to be transferred to rollers, and adverse effects result not only for images but also for transportability as well as processing devices. Upon heating the material, silver images are formed through an oxidation-reduction reaction between aliphatic carboxylic acid silver salts (which function as an oxidizing agent) and reducing agents. This reaction proceeds without any supply of processing solutions such as water from the exterior.

Heating may be carried out employing typical heating means such as hot plates, irons, hot rollers and heat generators employing carbon and white titanium. When the protective layer-provided silver salt photothermographic dry imaging material of the present invention is heated, from the viewpoint of uniform heating, heating efficiency, and workability, it is preferable that heating is carried out while the surface of the side provided with the protective layer comes into contact with a heating means, and thermal development is carried out during the transport of the material while the surface comes into contact with the heating rollers.

EXAMPLE

The present invention will now be detailed with reference to examples. However, the present invention is not limited to these examples.

Example 1

<<Preparation of Subbed Photographic Supports>>

A photographic support composed of a 175 μm thick biaxially oriented polyethylene terephthalate film with blue tinted at an optical density of 0.170 (determined by Densitometer PDA-65, manufactured by Konica Corp.), which had been subjected to corona discharge treatment of 8 W·minute/$m^2$ on both sides, was subjected to subbing. Namely, subbing liquid coating composition a-1 was applied onto one side of the above photographic support at 22° C. and 100 m/minute to result in a dried layer thickness of 0.2 μm and dried at 140° C., whereby a subbing layer on the image forming layer side (designated as Subbing Layer A-1) was formed. Further, subbing liquid coating composition b-1 described below was applied, as a backing layer subbing layer, onto the opposite side at 22° C. and 100 m/minute to result in a dried layer thickness of 0.12 μm and dried at 140° C. An electrically conductive subbing layer (designated as Subbing Lower Layer B-1), which exhibited an antistatic function, was applied onto the backing layer side. The surface of Subbing Lower Layer A-1 and Subbing Lower Layer B-1 was subjected to corona discharge treatment of 8 W·minute/$m^2$. Subsequently, subbing liquid coating composition a-2 was applied onto Subbing Lower Layer A-1 was applied at 33° C. and 100 m/minute to result in a dried layer thickness of 0.03 μm and dried at 140° C. The resulting layer was designated as Subbing Upper Layer A-2. Subbing liquid coating composition b-2 described below was applied onto Subbing Lower Layer B-1 at 33° C. and 100 m/minute to results in a dried layer thickness of 0.2 μm and dried at 140° C. The resulting layer was designated as Subbing Upper Layer B-2. Thereafter, the resulting support was subjected to heat treatment at 123° C. for two minutes and wound up under the conditions of 25° C. and 50 percent relative humidity, whereby a subbed sample was prepared.

(Preparation of Water-based Polyester A-1)

A mixture consisting of 35.4 parts by weight of dimethyl terephthalate, 33.63 parts by weight of dimethyl isophthalate, 17.92 parts by weight of sodium salt of dimethyl 5-sulfoisophthalate, 62 parts by weight of ethylene glycol, 0.065 part by weight of calcium acetate monohydrate, and 0.022 part by weight of manganese acetate tetrahydrate underwent transesterification at 170–220° C. under a flow of nitrogen while distilling out methanol. Thereafter, 0.04 part by weight of trimethyl phosphate, 0.04 part by weight of antimony trioxide, and 6.8 parts by weight of 4-cyclohexanedicarboxylic acid were added. The resulting mixture underwent esterification at a reaction temperature of 220–235° C. while distilling out a nearly theoretical amount of water.

Thereafter, the reaction system was subjected to pressure reduction and heating over a period of one hour and was subjected to polycondensation at a final temperature of 280° C. and a maximum pressure of 133 Pa for one hour, whereby Water-soluble Polyester A-1 was synthesized. The intrinsic viscosity of the resulting Water-soluble Polyester A-1 was 0.33, the average particle diameters was 40 nm, and Mw was 80,000–100,000.

Subsequently, 850 ml of pure water was placed in a 2-liter three-necked flask fitted with stirring blades, a refluxing cooling pipe, and a thermometer, and while rotating the stirring blades, 150 g of Water-soluble Polyester A-1 was gradually added. The resulting mixture was stirred at room temperature for 30 minutes without any modification. Thereafter, the interior temperature was raised to 98° C. over a period of 1.5 hours and at that resulting temperature, dissolution was performed. Thereafter, the temperature was lowered to room temperature over a period of one hour and the resulting product was allow to stand overnight, whereby Water-based Polyester A-1 Solution was prepared.

(Preparation of Modified Water-based Polyester B-1 and B-2 Solutions)

Placed in a 3-liter four-necked flask fitted with stirring blades, a reflux cooling pipe, a thermometer, and a dripping funnel was 1,900 ml of the aforesaid 15 percent by weight Water-based Polyester A-1 Solution, and the interior temperature was raised to 80° C., while rotating the stirring blades. Into this added was 6.52 ml of a 24 percent aqueous ammonium peroxide solution, and a monomer mixed liquid composition (consisting of 28.5 g of glycidyl methacrylate, 21.4 g of ethyl acrylate, and 21.4 g of methyl methacrylate) was dripped over a period of 30 minutes, and reaction was allowed for an additional 3 hours. Thereafter, the resulting product was cooled to at most 30° C., and filtrated, whereby Modified Water-based Polyesters B-1 Solution (vinyl based component modification ratio of 20 percent by weight) at a solid concentration of 18 percent by weight was obtained.

Modified Water-based Polyester B-2 at a solid concentration of 18 percent by weight (a vinyl based component modification ratio of 20 percent by weight) was prepared in the same manner as above except that the vinyl modification ratio was changed to 36 percent by weight and the modified component was changed to styrene:glycidyl methacrylate:acetacetoxyethyl methacrylate:n-butyl acrylate=39.5:40:20:0.5.

(Preparation of Acryl Based Polymer Latexes C-1-C-3)

Acryl Based Polymer Latexes C-1-C-3 having the monomer compositions shown in the following table were synthesized employing emulsion polymerization. All the solid concentrations were adjusted to 30 percent by weight.

TABLE 2

| Latex No. | Monomer Composition (weight ratio) | Tg (° C.) |
|---|---|---|
| C-1 | styrene:glycidyl methacrylate:n-butyl acrylate = 20:40:40 | 20 |
| C-2 | styrene:n-butyl acrylate:t-butyl acrylate:hydroxyethyl methacrylate = 27:10:35:28 | 55 |
| C-3 | styrene:glycidyl methacrylate: acetacetoxyethyl methacrylate = 40:40:20 | 50 |

| (Subbing Lower Layer Liquid Coating Composition a-1 on Image Forming Layer Side) | |
|---|---|
| Acryl Based Polymer Larex C-3 (30 percent solids) | 70.0 g |
| Water dispersion of ethoxylated alcohol and ethylene homopolymer (10 percent solids) | 5.0 g |
| Surface Active Agent (A) | 0.1 g |

A coating liquid composition was prepared by adding water to make 1,000 ml.

| <<Image Forming Layer Side Subbing Upper Layer Liquid Coating Composition a-2>> | |
|---|---|
| Modified Water-based Polyester B-2 (18 percent by weight) | 30.0 g |
| Surface Active Agent (A) | 0.1 g |
| Spherical silica matting agent (Sea Hoster KE-P50, manufactured by Nippon Shokubai Co., Ltd.) | 0.04 g |

A liquid coating composition was prepared by adding water to make 1,000 ml.

| (Backing Layer Side Subbing Lower Layer Liquid Coating Composition b-1) | |
|---|---|
| Acryl Based Polymer Late C-1 (30 percent solids) | 30.0 g |
| Acryl Based Polymer Late C-2 (30 percent solids) | 7.6 g |
| $SnO_2$ sol (the solid concentration of $SnO_2$ sol synthesized employing the method described in Example 1 of Japanese Patent Publication 35–6616 was heated and concentrated to reach a solid concentration of 10 percent by weight, and subsequently, the pH was adjusted to 10 by the addition of ammonia water) | 180 g |
| Surface Active Agent (A) | 0.5 g |
| 5 percent by weight of PVA-613 (PVA, manufactured by Kuraray Co., Ltd.) | 0.4 g |

A liquid coating composition was prepared by adding water to make 1,000 ml.

| (Backing Layer Side Subbing Upper Layer Liquid Coatings composition b-2) | |
|---|---|
| Modified Water-based Polyester B-1 (18 percent by weight) | 145.0 g |
| Spherical silica matting agent (Sea Hoster KE-P50, manufactured by Nippon Shokubai Co., Ltd.) | 0.2 g |
| Surface Active Agent (A) | 0.1 g |

A liquid coating composition was prepared by adding water to make 1,000 ml.

Incidentally, an antihalation layer having the composition described below was applied onto Subbing Layer A-2 applied onto the aforesaid support.

| (Antihalation Layer Coating Composition) | |
|---|---|
| PVB-1 (binding agent) | 0.8 $g/m^2$ |
| C1 (dye) | $1.2 \times 10^{-5}$ $mol/m^2$ |

On the other hand, each of the liquid coating compositions of a BC layer and its protective layer which was prepared to achieve a coated amount (per $m^2$) described below was successively applied onto the aforesaid Subbing Upper Layer B-2 and subsequently dried, whereby a BC layer and a protective layer were formed.

| (BC Layer Composition) | |
|---|---|
| PVB-1 (binding agent) | 1.8 g |
| C1 (dye) | $1.2 \times 10^{-5}$ mol |
| **(BC Layer Protective Layer Liquid Coating Composition)** | |
| Cellulose acetate butyrate | 1.1 g |
| Matting agent (polymethyl methacrylate at an average particle diameter of 5 μm) | 0.12 g |
| Antistatic agent F-EO | 250 mg |
| Antistatic agent F-DS1 | 30 mg |

Surface active agent (A)

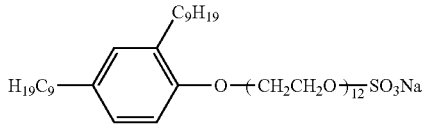

C1 (dye)

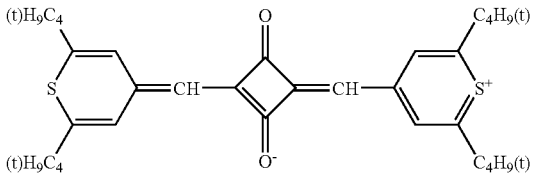

F-EO

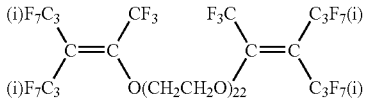

F-DS1

$LiO_3S—(CF_2)_3—SO_3Li$

<<Preparation of Photosensitive Silver Halide Emulsion>>

| (Solution A1) | |
|---|---|
| Phenylcarbamoyl-modified gelatin | 88.3 g |
| Compound (*1) (10% aqueous methanol solution) | 10 ml |
| Potassium bromide | 0.32 g |
| Water to make | 5429 ml |
| **(Solution B1)** | |
| 0.67 mol/L aqueous silver nitrate solution | 2635 ml |
| **(Solution C1)** | |
| Potassium bromide | 51.55 g |

-continued

Surface active agent (A)

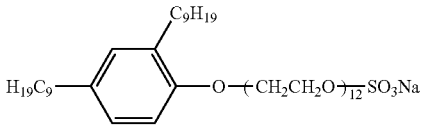

C1 (dye)

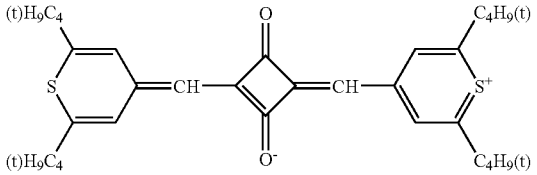

F-EO

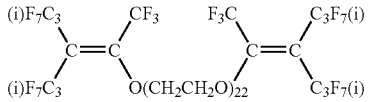

F-DS1

$LiO_3S—(CF_2)_3—SO_3Li$

<<Preparation of Photosensitive Silver Halide Emulsion>>

| | |
|---|---|
| Potassium iodide | 1.47 g |
| Water to make | 660 ml |
| (Solution D1) | |
| Potassium bromide | 154.9 g |
| Potassium iodide | 4.41 g |
| $K_3IrCl_6$ (equivalent to $4 \times 10^{-5}$ mol/Ag) | 50.0 ml |
| Water to make | 1982 ml |
| (Solution E1) | |
| 0.4 mol/L aqueous potassium bromide solution the following amount controlled by silver potential | |
| (Solution F1) | |
| Potassium hydroxide | 0.71 g |
| Water to make | 20 ml |
| (Solution G1) | |
| 56 percent aqueous acetic acid solution | 18.0 ml |
| (Solution H1) | |
| Sodium carbonate anhydride | 1.72 g |
| Water to make | 151 ml |

(*1) Compound A: $HO(CH_2CH_2O)_n(CH(CH_3)CH_2O)_{17}(CH_2CH_2O)_mH$ (m + N = 5 through 7)

Upon employing a mixing stirrer shown in Japanese Patent Publication No. 58-58288, ¼ portion of Solution B1 and whole Solution C1 were added to Solution A1 over 4 minutes 45 seconds, employing a double-jet precipitation method while adjusting the temperature to 30° C. and the pAg to 8.09, whereby nuclei were formed. After one minute, whole Solution F1 was added. Subsequently, 4 ml of 0.1% ethanol solution with respect to the following compound (ETTU) was added. During the addition, the pAg was appropriately adjusted employing Solution E1. After 6 minutes, ¾ portion of Solution B1 and whole Solution D1 were added over 14 minutes 15 seconds, employing a double-jet precipitation method while adjusting the temperature to 30° C. and the pAg to 8.09. After stirring for 5 minutes, the mixture was cooled to 40° C., and whole Solution G1 was added, whereby a silver halide emulsion was flocculated. Subsequently, while leaving 2000 ml of the flocculated portion, the supernatant was removed, and 10 L of water was added. After stirring, the silver halide emulsion was again flocculated. While leaving 1,500 ml of the flocculated portion, the supernatant was removed. Further, 10 L of water was added. After stirring, the silver halide emulsion was flocculated. While leaving 1,500 ml of the flocculated portion, the supernatant was removed. Subsequently, Solution H1 was added and the resultant mixture was heated to 60° C., and then stirred for an additional 120 minutes. Finally, the pH was adjusted to 5.8 and water was added so that the weight was adjusted to 1,161 g per mol of silver, whereby an emulsion was prepared.

The prepared emulsion was composed of monodispersed cubic silver iodobromide grains having an average grain size of 0.042 μm, a grain size variation coefficient of 10 percent and a (100) surface ratio of 92 percent.

<<Preparation of Photosensitive Layer Coating Composition>>

(Preparation of Powder Aliphatic Carboxylic Acid Silver Salt A)

Dissolved in 4,720 ml of pure water were 117.7 g of silver behenate, 60.9 g of arachidic acid, 39.2 g of stearic acid, and 2.1 g of palmitic acid at 80° C. Subsequently, 486.2 ml of a 1.5 M aqueous sodium hydroxide solution was added, and further, 6.2 ml of concentrated nitric acid was added. Thereafter, the resultant mixture was cooled to 55° C., whereby an aliphatic acid sodium salt solution was prepared. After 347 ml of t-butyl alcohol was added and stirred for 20 min, the above-described Photosensitive Silver Halide Emulsion 1 as well as 450 ml of pure water was added and stirred for 5 minutes.

Subsequently, 702.6 ml of one mol silver nitrate solution was added over two minutes and stirred for 10 minutes, whereby an aliphatic carboxylic acid silver salt dispersion was prepared. Thereafter, the resultant aliphatic carboxylic acid silver salt dispersion was transferred to a water washing machine, and deionized water was added. After stirring, the resultant dispersion was allowed to stand, whereby a flocculated aliphatic carboxylic acid silver salt was allowed to float and was separated, and the lower portion, containing water-soluble salts, were removed. Thereafter, washing was repeated employing deionized water until electric conductivity of the resultant effluent reached 50 μS/cm. After centrifugal dehydration, the resultant cake-shaped aliphatic carboxylic acid silver salt was dried employing an gas flow type dryer Flush Jet Dryer (manufactured by Seishin Kikaku Co., Ltd.), while setting the drying conditions such as nitrogen gas as well as heating flow temperature at the inlet of the dryer, until its water content ratio reached 0.1 percent, whereby Powder Aliphatic Carboxylic Acid Silver Salt A was prepared. The water content ratio of aliphatic carboxylic acid silver salt compositions was determined employing an infrared moisture meter. A silver salt conversion ratio of the aliphatic carboxylic acid was confirmed to be about 95%, measured by the above-described method.

<<Preparation of Preliminary Dispersion A>>

Dissolved in 1457 g of methyl ethyl ketone (hereinafter referred to as MEK) was 14.57 g of poly(vinyl butyral) resin P-9. While stirring, employing Dissolver DISPERMAT Type CA-40M, manufactured by VMA-Getzmann Co., 500 g of aforesaid Powder Aliphatic Carboxylic Acid Silver Salt A was gradually added and sufficiently mixed, whereby Preliminary Dispersion A was prepared.

(Preparation of Photosensitive Emulsion A)

Preliminary Dispersion A, prepared as above, was charged into a media type homogenizer DISPERMAT Type SL-C12EX (manufactured by VMA-Getzmann Co.), filled with 0.5 mm diameter zirconia beads so as to occupy 80 percent of the interior volume so that the retention time in the mill reached 1.5 minutes and was dispersed at a peripheral rate of the mill of 8 m/second, whereby Photosensitive Emulsion A was prepared.

(Preparation of Stabilizer Solution)

Stabilizer Solution was prepared by dissolving 1.0 g of Stabilizer 1 and 0.31 g of potassium acetate in 4.97 g of methanol.

(Preparation of Infrared Sensitizing Dye A Solution)

Infrared Sensitizing Dye A Solution was prepared by dissolving 19.2 mg of Infrared Sensitizing Dye 1, 10 mg of Infrared Sensitizing Dye 2, 1.48 g of 2-chloro-benzoic acid, 2.78 g of Stabilizer 2, and 365 mg of 5-methyl-2-mercaptobenzimidazole in 31.3 ml of MEK in a light-shielded room.

(Preparation of Additive Solution "a")

Additive Solution "a" was prepared by dissolving 14.0 g of each of the following compounds (RED-1 and RED-2) and 1.54 g of 4-methylphthalic acid as developing agents, and 0.20 g of aforesaid Infrared Dye 1 in 110 g of MEK, and subsequently by adding 75 mg of each of the following compounds (YL-1 and CL-1) as leuco dyes.

(Preparation of Additive Solution "b")

Additive Solution "b" was prepared by dissolving 3.56 g of Antifoggant 2 and 3.43 g of phthalazine in 40.9 g of MEK.

(Preparation of Photosensitive Layer Coating Composition A)

While stirring, 50 g of aforesaid Photosensitive Emulsion A and 15.11 g of MEK were mixed and the resultant mixture was maintained at 21° C. Subsequently, 390 μl of Antifoggant 1 (being a 10 percent methanol solution) was added and stirred for one hour. A chemical sensitization process was conducted by adding 240 ml of sulfur sensitizer S-5 (0.5% methanol solution), and stirring at 21° C. for one hour. Further, 494 μl of calcium bromide (being a 10 percent methanol solution) was added and stirred for 20 minutes. Subsequently, 167 ml of aforesaid Stabilizer Solution was added and stirred for 10 minutes. Thereafter, 1.32 g of aforesaid Infrared Sensitizing Dye A was added and the resulting mixture was stirred for one hour. Subsequently, the resulting mixture was cooled to 13° C. and stirred for an additional 30 minutes. While maintaining at 13° C., 13.31 g of poly (vinyl acetal) Resin P-1 as a binder was added and stirred for 30 minutes. Thereafter, 1.084 g of tetrachlorophthalic acid (being a 9.4 weight percent MEK solution) was added and stirred for 15 minutes. Further, while stirring, 12.43 g of Additive Solution "a", 1.6 ml of Desmodur N3300/aliphatic isocyanate, manufactured by Mobay Chemical Co. (being a 10 percent MEK solution), and 4.27 g of Additive solution "b" were successively added, whereby Photosensitive Layer Coating Composition A was prepared.

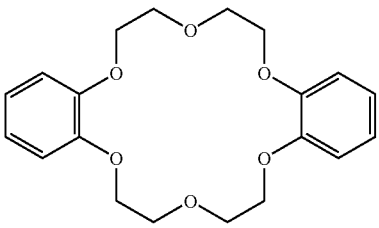

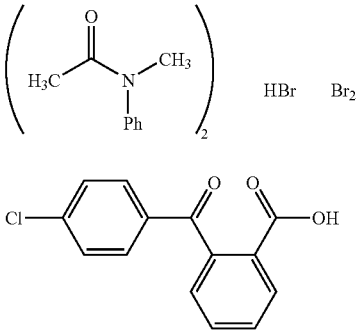

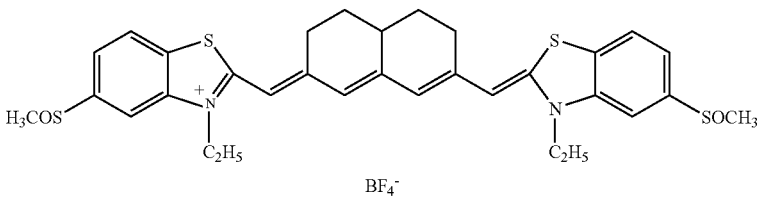

Stabilizer 1

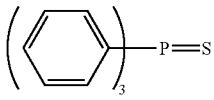

ETTU

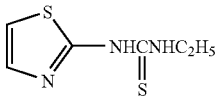

Antifoggant 2

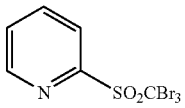

Infrared sensitizing dye 1

-continued

Infrared sensitizing dye 2

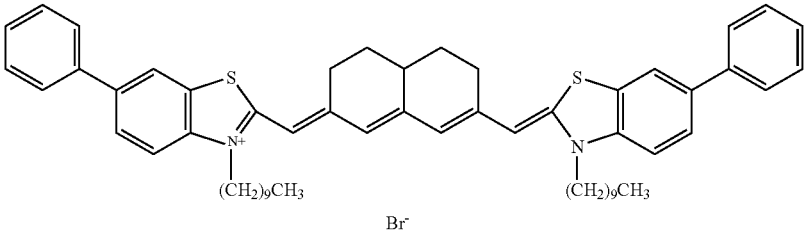

(RED-2)

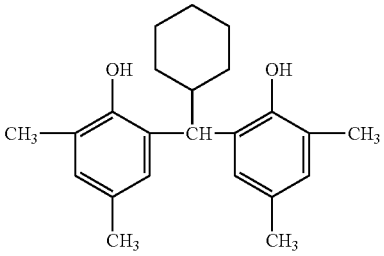

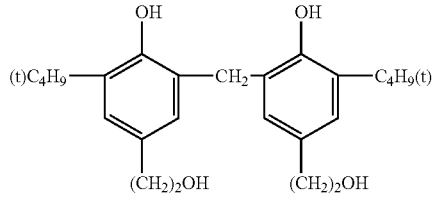

(YL-1)

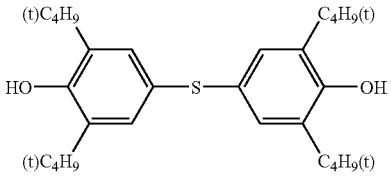

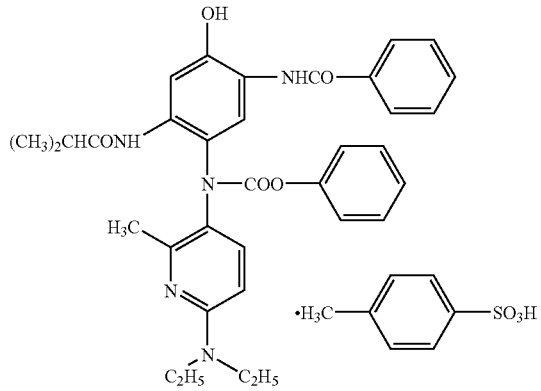

<<Surface Protective Layer>>

The liquid coating composition having the formulation described below was prepared in the same manner as the photosensitive layer liquid coating composition and was subsequently applied onto a photosensitive layer to result in the coated amount (per $m^2$) below, and subsequently dried, whereby a photosensitive layer protective layer was formed.

| | |
|---|---|
| Cellulose acetate propionate | 2.0 g |
| 4-Methyl phthalate | 0.7 g |
| Tetrachlorophthalic acid | 0.2 g |
| Tetrachlorophthalic anhydride | 0.5 g |
| Silica matting agent (at an average diameter of 5 μm) | 0.5 g |
| 1,3-bis(vinylsulfonyl)-2-propanol | 50 mg |
| Benzotriazole | 30 mg |
| Antistatic Agent: F-EO | 20 mg |
| Antistatic Agent: F-DS1 | 3 mg |

Incidentally, polyacetal was employed as a binding agent, and methyl ethyl ketone (MEK) was employed as an organic solvent. Polyacetal was prepared as follows. Polyvinyl acetate at a degree of polymerization of 500 was saponified to a ratio of 98 percent, and subsequently, 86 percent of the residual hydroxyl groups were butylated. The resulting polyacetal was designated as PVB-1.

<<Preparation of Photothermographic Dry Imaging Material 1>>

Photosensitive layer liquid coating composition A and the surface protective layer liquid coating composition, prepared as above, were simultaneously applied onto the subbing layer on the support prepared as above, employing a prior art extrusion type coater. The coating was performed so that the coated silver amount of the photosensitive layer reached 1.5 g/$m^2$ and the thickness of the surface protective layer reached 2.5 μm after drying. Thereafter, drying was performed employing a 75° C. drying air flow and a dew point of 10° C. for 10 minutes, whereby photothermographic dry imaging material 1 was prepared (Sample Nos. 1–12).

<<Preparation of Photothermographic Dry Imaging Material 2>>

Photothermographic dry imaging material 2 was prepared in the same manner as photothermographic dry imaging material 1 (117.7 g of silver behenate, 60.9 g of arachidic acid, 39.2 g of stearic acid, and 2.1 g of palmitic acid which were used, based on preparation of powder aliphatic carboxylic acid silver salt A), except that 219.9 g of silver behenate was employed (Sample No. 13).

<<Evaluation of Each Characteristic>>

(Exposure and Development Process)

Photothermographic dry imaging material 1 (Film 1) or photothermographic dry imaging material 2 (Film 2) prepared as above is set in film storage portion 4 of the laser imager shown in FIG. 1, and is transported via film guide 10. (Only a few rollers are shown, though the number of transporting rollers 2 are actually arranged to outlet 7. Incidentally, transporting rollers 2 are set only on the light-sensitive surface side in developing device 3.) Scanning exposure was performed by exposure device 6 onto transported photothermographic dry imaging material 1 or 2 from the light-sensitive surface side as shown in FIG. 1(*a*) and from the light-insensitive surface side as shown in FIG. 1(*b*), employing an exposure apparatus in which a semiconductor laser, which was subjected to a longitudinal multi-mode of a wavelength of 800 to 820 nm, employing high frequency superposition, was used as a laser beam source. In such a case, images were formed while adjusting the angle between the exposure surface of photothermographic dry imaging material 1 and the exposure laser beam to 75 degrees. By employing such a method, compared to the case in which the angle was adjusted to 90 degrees, images which minimized unevenness and exhibited surprisingly excellent sharpness were obtained.

Thereafter, the light-insensitive surface of photothermographic dry imaging material 1 or 2 was brought into contact with the surface of developing device 3, and thermal development was carried out at 123° C. for 15 seconds. The thermal development was also carried out at a transporting speed of 32 mm/second at the developing device portion. In FIG. 1, dust and foreign matter are removed since photothermographic dry imaging material 1 or 2 is brought into contact with sticky rollers 5 in the area before and after developing device 3. FIG. 1(*a*) shows that exposure device 6 is placed above photothermographic dry imaging material 1 or 2, while FIG. 1(*b*) shows that exposure device 6 is placed below photothermographic dry imaging material 1 or 2. Incidentally, the operation of laser imagers was carried out in a room conditioned to 23° C. and 50 percent relative humidity.

(Measurement of Amount of Peel-off Static Electrification)

The amount of peel-off static electrification of imaging materials, which passed through immediately after the sticky rollers, was measured at 23° C. and 50 percent relative humidity from the light-sensitive surface side at a wide range mode and at a measured distance of 70 mm, employing electrostatic sensor SK-030/200 manufactured by Keyence Corporation. After 10 films of imaging material were processed in succession, the measured value was averaged to be used as the measured data of the amount of peel-off static electrification.

(Measurement of Image Quality)

White spot: Measurement of the number of white spots having a maximum diameter of 5.0 mm on a 14×17 inch (355.6×431.8 mm) size of imaging materials after development was conducted.

Sharpness and Graininess: Sharpness and graininess were measured visually, and overall evaluation was made via each of the evaluated data.

5: Excellent image quality for medical, or specifically mammography, diagnosis images.

4: Satisfactory for common medical imaging, but for ordinary mammography images.

3: Acceptable images for ordinary medical diagnosis.

2: Barely acceptable images for medical diagnosis.

1: Unacceptable images for medical diagnosis.

TABLE 3

| | Sticky roller | | | | | |
|---|---|---|---|---|---|---|
| No. | Product Name (Material) | Adhesive Force (hPa) | Hardness (JIS A) | Removing action of static electrification | Pull-off static electrification | Film postion upon exposure |
| 1 | *1 | 33 | 28 | Non | 7 | *3 |
| 2 | *1 | 33 | 28 | Non | 7 | *4 |
| 3 | *2 | 52 | 26 | Non | 8 | *3 |
| 4 | *2 | 52 | 26 | Non | 8 | *4 |
| 5 | MIMOSA LT | 19 | 35 | Non | 3 | *4 |
| 6 | MIMOSA ST | 35 | 30 | Non | 2 | *4 |
| 7 | BLEEDLESS MIMOSA MT | 55 | 40 | Non | 2 | *4 |
| 8 | CARBOLESS MIMOSA ULT | 13 | 30 | Yes | 1 | *4 |
| 9 | CARBOLESS MIMOSA LT | 27 | 35 | Yes | 0 | *4 |
| 10 | CARBOLESS MIMOSA ST | 62 | 25 | Yes | 1 | *4 |
| 11 | CARBOLESS MIMOSA ULT | 13 | 30 | Yes | 1 | *3 |
| 12 | CARBOLESS MIMOSA LT | 27 | 35 | Yes | 0 | *3 |
| 13 | CARBOLESS MIMOSA ULT | 13 | 30 | Yes | 1 | *3 |

TABLE 3-continued

| No. | Air cleanlyness class in the portion of exposure device | Air cleanlyness class in the portion of developing device | Image Quality: A number of white spots (a diameter of not more than 0.5 mm in a 14 × 17 inch size) | Sharpness | Graininess | Overall evaluation | Remarks |
|---|---|---|---|---|---|---|---|
| 1 | 7 | 7 | 5 | 3 | 4 | 3.5 | Comp. |
| 2 | 6 | 6 | 2.5 | 4 | 4 | 4 | Comp. |
| 3 | 6 | 6 | 4 | 3.5 | 4 | 4 | Comp. |
| 4 | 5 | 5 | 2 | 4 | 4 | 4 | Comp. |
| 5 | 4 | 4 | 1 | 4.5 | 5 | 5 | Inv. |
| 6 | 4 | 4 | 0.5 | 5 | 5 | 5 | Inv. |
| 7 | 4 | 4 | 0.5 | 5 | 5 | 5 | Inv. |
| 8 | 4 | 4 | 0.5 | 5 | 5 | 5 | Inv. |
| 9 | 4 | 4 | 0 | 5 | 5 | 5 | Inv. |
| 10 | 3.5 | 3.5 | 0.5 | 5 | 5 | 5 | Inv. |
| 11 | 4 | 4 | 1.0 | 4.5 | 5 | 5 | Inv. |
| 12 | 4 | 4 | 0.5 | 5 | 5 | 5 | Inv. |
| 13 | 4 | 4 | 1.0 | 4.5 | 5 | 5 | Inv. |

*1: Comparative roller (Urethane rubber)
*2: Comparative roller (Silicone rubber)
*3: below exposure device
*4: above exposure device
Comp.: Comparative
Inv.: Present invention As seen in Table 3, sharpness and graininess are improved in the present invention since the number of white spots decrease, and high quality images enable more accurate diagnosis.

[EFFECT OF THE INVENTION]

Substantially higher quality images enabled more accurate diagnosis in the present invention, except that image quality was improved since the number of white spots due to dust and foreign matter was reduced. It is assumed that sharpness and graininess were also improved, because light-scattering due to dust and foreign matter during exposure to the writing laser beam was suppressed.

What is claimed is:

1. An image forming process comprising the steps of:

(a) exposing by an exposure device a photothermographic dry imaging material comprising a support having thereon an image forming layer containing photosensitive silver halide, a reducing agent for silver ions, a binder and a light-insensitive organic silver salt, and (b) developing the photothermographic dry imaging material by a developing device, while the photothermographic dry imaging material is transported, wherein a surface having the image forming layer is brought into contact with sticky rollers during or before each of exposing and developing so as to make an amount of peel-off static electrification between the photothermographic dry imaging material and the sticky roller to be from −5 to +5 kV.

2. The image forming process of claim 1, wherein exposure is conducted with an exposure device located below where the photothermographic dry imaging material is exposed.

3. The image forming process of claim 1, wherein an air cleanliness class defined by ISO 14644-1 at the portion of an exposure device is not more than 5.

4. The image forming process of claim 1, wherein the air cleanliness class defined by ISO 14644-1 at the portion of a developing device is not more than 5.

5. The image forming process of claim 1, wherein sticky rollers comprise a function to remove static electrification.

6. The image forming process of claim 1, wherein static electrification is removed when the photothermographic dry imaging material is brought into contact with sticky rollers.

7. The image forming process of claim 1, wherein static electrification is removed before the photothermographic dry imaging material is brought into contact with sticky rollers.

8. The image forming process of claim 1, wherein a transporting speed at the developing device is from 30 to 60 mm/second.

9. The image forming process of claim 1, wherein the photothermographic dry imaging material comprises a light-sensitive layer containing silver halide particles and aliphatic carboxylic acid silver, and the content ratio of silver behenate in the aliphatic carboxylic acid silver is from 80 to 100 percent by mol.

10. The image forming process of claim 1, wherein the photothermographic dry imaging material comprises a light-sensitive layer containing silver halide particles and reducing agents for silver ions, and the reducing agents for silver ions are compounds represented by the following General Formula (RED).

General Formula (RED)

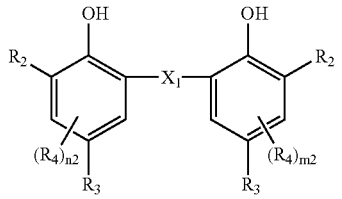

wherein $X_1$ represents a chalcogen atom or $CHR_1$; $R_1$ being a hydrogen atom, a halogen atom, an alkyl group, an alkenyl group, an aryl group or a heterocyclic group; $R_2$ represents an alkyl group; $R_3$ represents a hydrogen atom or a substituent capable of substituting a hydrogen atom on a benzene ring; $R_4$ represents a substituent; and m2 and n2 each represents an integer of 0 to 2.

11. The image forming process of claim 1, wherein the photothermographic dry imaging material comprises a light-sensitive layer containing photosensitive silver halide particles, and the photosensitive silver halide particles are chemically sensitized employing organic sensitizers containing chalcogen atoms.

12. The image forming process of claim 1, wherein color image forming agents are contained which increase absorbance between 360 and 450 nm via oxidation.

13. The image forming process of claim 1, wherein color image forming agents are contained which increase absorbance between 600 and 700 nm via oxidation.

* * * * *